US007528534B2

(12) United States Patent
Kuki et al.

(10) Patent No.: US 7,528,534 B2
(45) Date of Patent: May 5, 2009

(54) SPARK PLUG

(75) Inventors: Hiroaki Kuki, Nagoya (JP); Akira Suzuki, Aichi (JP); Yoshihiro Matsubara, Mie (JP); Kazuhiko Mori, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 328 days.

(21) Appl. No.: 10/583,252

(22) PCT Filed: Dec. 15, 2004

(86) PCT No.: PCT/JP2004/018743

§ 371 (c)(1),
(2), (4) Date: Jun. 16, 2006

(87) PCT Pub. No.: WO2005/060060

PCT Pub. Date: Jun. 30, 2005

(65) Prior Publication Data

US 2007/0126330 A1 Jun. 7, 2007

(30) Foreign Application Priority Data

Dec. 19, 2003 (JP) ..... 2003-422458

(51) Int. Cl.
*H01T 13/20* (2006.01)

(52) U.S. Cl. ..... 313/143; 313/118; 313/141

(58) Field of Classification Search ..... 313/118, 313/141, 143–145
See application file for complete search history.

(56) References Cited

U.S. PATENT DOCUMENTS

| | | | | |
|---|---|---|---|---|
| 6,091,185 | A * | 7/2000 | Matsubara et al. | 313/138 |
| 2001/0002096 | A1 * | 5/2001 | Honda et al. | 313/143 |
| 2003/0117052 | A1 * | 6/2003 | Yamaguchi et al. | 313/118 |
| 2003/0127959 | A1 * | 7/2003 | Nishikawa et al. | 313/143 |
| 2003/0214210 | A1 * | 11/2003 | Lipp et al. | 313/118 |

FOREIGN PATENT DOCUMENTS

| | | | |
|---|---|---|---|
| JP | 6-196247 | A | 7/1994 |
| JP | 2000-277230 | A | 10/2000 |
| JP | 2002-260817 | A | 9/2002 |

* cited by examiner

*Primary Examiner*—Karabi Guharay
*Assistant Examiner*—Kevin Quarterman
(74) *Attorney, Agent, or Firm*—Sughrue Mion, PLLC

(57) ABSTRACT

There is provided a spark plug wherein an insulator and a metallic shell, when observed in a section made by a plane including an axis of a spark plug, have therebetween a gap of less than 0.45 mm at a more front end side than an engagement position of a packing and a first insulator stepped portion, and the gap is provided axially from a most front end side engagement position of the packing and a first insulator stepped portion as a starting point to a finishing point that is apart from the starting point by 1.2 mm or more toward the front end side while being apart from a front end surface of the metallic shell by 7.9 mm or more toward a rear end side.

12 Claims, 9 Drawing Sheets

SPARK PLUG

TECHNICAL FIELD

This invention relates to a spark plug for an internal combustion engine and particularly to a spark plug having a heat resistance and a fouling resistance.

BACKGROUND TECHNIQUE

Heretofore, since in a spark plug used for ignition in an internal combustion engine such as an automotive gasoline engine, gasoline and air are mixed and combustion in a short time within a combustion chamber at an engine head, incomplete combustion is liable to be caused to allow carbon or the like to be adhered to a front end portion of an insulator of the spark plug, thus being causative of fouling. When a large amount of carbon is adhered to the front end portion of the insulator of the spark plug, spark is not produced at the front end of the spark plug but a leakage (electric leakage) phenomenon in which spark is produced at a different portion to which carbon is adhered. On the other hand, the carbon has a property of all being burned out when heated up to about 520° C. or more. By noticing such a character of carbon, it is generally used such a spark plug having a self-cleaning function of increasing in the temperature up to about 520° C. at a stretch and burning away carbon by itself.

Further, a spark plug is configured so that a nearly tubular insulator, in which a center electrode that produces spark discharge (spark) is disposed so as to protrude from a front end thereof, is fitted in a nearly tubular metallic shell. The diameter of the front end portion of the insulator is smaller than that of the axially intermediate portion thereof, and the stepped portion between the front end portion and the intermediate portion is adapted to engage the stepped portion provided to the inside of the metallic shell. Heretofore, a large gap between the front end portion of the insulator and the metallic shell has been considered effective for preventing spark jumping produced across the gap at the time of fouling of the insulator. However, if the width of the gap is made larger, the outer diameter of the metallic shell becomes larger and therefore the spark plug itself becomes larger in size. Thus, it has been proposed such a spark plug that is configured to make a gap be equal to or smaller than a predetermined value at a more front end side than an engagement position of the insulator and the metallic shell, thereby being capable of assuredly stopping intrusion of unburnt gas into the gap at the engagement position and preventing fouling of the spark plug (refer to, for example, Patent Document 1).

On the other hand, for the purpose of reducing the fuel consumption of the automotive vehicle, development of lean burn (combustion of a lean air-fuel ratio mixture) in the engine has been made, and when the engine is in such a lean burn condition the spark plug is required to carry out ignition assuredly and therefore it is necessitated to make higher the ignition voltage of the spark plug. Thus, it has also proposed such a spark plug that is configured to provide the inside of the metallic shell with a stepped portion for engagement with the insulator and make the front end side of the insulator, which is positioned opposite to the corner of the stepped portion, be shaped to have the thickness that is equal to or larger than that of the joining portion between the stepped portion and the leg portion of the insulator, whereby the electrical insulation resistance of the insulator leg portion positioned opposite to the corner of the stepped portion of the metallic shell can be improved and production of a pin hole can be inhibited (refer to, for example, Patent Document 2).

Patent Document 1: Unexamined Japanese Patent Publication No. 2002-260817.

Patent Document 2: Unexamined Japanese Patent Publication No. 6-196247.

However, in the spark plug described in the Patent Document 1, the engagement gap between the metallic shell and the insulator is designed to be small, thus being capable of preventing intrusion of unburnt gas but causing the thermal value to become low (low heat radiation rate, removal of heat being bad) since the small gap portion is short in the length in the axial direction of the spark plug, transfer of heat from the insulator to the metallic shell becomes difficult. As a result, the front end portion of the spark plug is excessively heated, thus causing a problem that there is a possibility of causing natural combustion (pre-ignition) before ignition. Further, in the spark plug described in the Patent document 2, the width of the engagement gap between metallic shell and the insulator is adjusted so as to be large, so that while the thermal value is large, intrusion of unburnt gas cannot be prevented, thus causing a problem that fouling is liable to be caused. In this manner, by the technique described in the Patent Documents 1 and 2, if one of the fouling resistance and the heat resistance (thermal value) is improved, the other is deteriorated, and therefore it is difficult to maintain both of the fouling resistance and the heat resistance good.

SUMMARY OF THE INVENTION

The present invention has been made with a view to solving the above-described problem and has for its object to provide a spark plug which can improve the heat resistance together with the fouling resistance.

A spark plug of the present invention includes a nearly tubular insulator having an axial through hole and a first insulator stepped portion that reduces in outer diameter toward a front end side, a rod-shaped center electrode disposed in the through hole of the insulator, a metallic shell having a first metallic shell stepped portion that reduces in inner diameter toward a front end side and supporting the insulator through engagement of the first metallic shell stepped portion and the first insulator stepped portion by interposing therebetween a packing, and a ground electrode connected at an end to a front end surface of the metallic shell and facing at the other end portion toward the center electrode for thereby forming a spark discharge gap between the other end portion of the ground electrode and the center electrode, characterized in that the insulator and the metallic shell, when observed in a section made by a plane including the axis of the spark plug, have therebetween a gap of less than 0.45 mm at a more front end side than an engagement position of the packing and the fist insulator stepped portion, and the gap is provided axially from a most front end side engagement position of the packing and the first insulator stepped portion as a starting point to a finishing point that is apart from the starting point by 1.2 mm or more toward a front end side while being apart from the front end surface of the metallic shell by 7.9 mm or more toward a rear end side.

Further, the spark plug of the present invention is characterized in that the gap is provided axially from a most front end side engagement position of the packing and the first insulator stepped portion as a starting point to a finishing point that is apart from the starting point by 1.5 mm or more toward a front end side while being apart from the front end surface of the metallic shell by 9.9 mm or more toward the rear end side.

Further, the spark plug of the present invention is characterized in that the insulator includes, at a more front end portion than the first insulator stepped portion, a second insulator stepped portion that reduces in diameter toward the front end side, the metallic shell includes, at a more front end side than the first metallic shell stepped portion, a second metallic shell stepped portion that increases in diameter toward the front end side, and the difference in outer diameter of the insulator between a front end and a rear end of the second insulator stepped portion is larger than the difference in inner diameter of the metallic shell between a front end and a rear end of the second metallic shell stepped portion.

Further, the spark plug of the present invention is characterized in that the second insulator stepped portion, when observed in a section made by a plane including the axis of the spark plug, forms an included angle of 10° or more with a line parallel with the axis.

Further, the spark plug of the present invention is characterized in that the rear end of the second insulator stepped portion is axially disposed at a more front end side than the front end of the first insulator stepped portion by an amount ranging from 1 to 6 mm.

Further, the spark plug of the present invention is characterized in that the rear end of the second insulator stepped portion is axially apart from the front end surface of the metallic shell by 7 mm or more.

Further, the spark plug of the present invention is characterized in that the rear end of the second insulator stepped portion, when observed in a section made by a plane including the axis of the spark plug, is axially apart from the rear end of the second metallic shell stepped portion as a starting point by an amount ranging from −0.5 to 3 mm wherein the amount apart from the starting point toward the front end side is designated by a positive value.

Further, the spark plug of the present invention is characterized in that the packing is made of a material having a thermal conductivity of 200 W/m·k or more.

Further, the spark plug of the present invention is characterized in that a thread portion is formed on an outer circumferential surface of the metallic shell and the nominal designation of the thread portion is M12 or less.

The spark plug of the present invention is characterized in that the axial length from a front end of the thread portion to the front end of the metallic shell is 2.5 mm or more.

The spark plug of the present invention is characterized in that the distance from the front end of the metallic shell to the most front end side engagement position of the packing and the first insulator stepped portion is 2 mm or more.

Further, the spark plug of the present invention is characterized in that the center electrode includes a first center electrode stepped portion increasing in outer diameter toward the rear end side, a center electrode smaller diameter portion connected to a rear end side of the first center electrode stepped portion, a second center electrode stepped portion connected to a rear end side of the center electrode smaller diameter portion and increasing in outer diameter toward the rear end side, and a center electrode larger diameter connected to the rear end side of the second center electrode stepped portion, and the front end of the insulator is positioned between the first insulator stepped portion and the second insulator stepped portion when observed in a section made by a plane including the axis of the spark plug.

According to the spark plug of the present invention, since when observed in a section made by a plane including the axis, the axial length of the gap between the insulator and the metallic shell, which gap is less than 0.45 mm and positioned at a more front end side than the engagement position of the packing and the first insulator stepped portion, is 1.2 mm or more, the heat received by the insulator is transmitted to the metallic shell rapidly. Accordingly, good removal of heat is attained and the pre-ignition can be effectively prevented. Further, since intrusion of unburnt gas (carbon) into the engagement gap between the insulator and the metallic shell is assuredly blocked, fouling of the front end side portion of the insulator can be prevented and an improved fouling resistance can be attained. Further, since the finishing point of the gap of less than 0.45 mm is apart from the front end surface of the metallic shell by 7.9 mm or more, "internal firing" (phenomena of spark discharge being caused inside the metallic shell and in the gap between the metallic shell and the insulator) due to carbon adhered to the front end side of the insulator is hard to be caused.

Further, according to the spark plug of the present invention, since when observed in a section made by a plane including the axis, the length of the gap between the insulator and the metallic shell, which gap is less than 0.45 mm and positioned at a more front end side than the engagement position of the packing and the first insulator stepped portion, is 1.5 mm or more, intrusion of unburnt gas into the engagement gap between the insulator and the metallic shell can be prevented further assuredly and fouling of the front end side portion of the insulator can be prevented assuredly. Further, since the finishing point of the gap of 0.45 mm or less is part from the front end surface of the metallic shell by 9.9 mm or more, the internal firing is further hard to be caused.

Further, according the spark plug of the present invention, since the difference in the outer diameter of the insulator between the front end and the rear end of the second insulator stepped portion is larger than the difference in the inner diameter of the metallic shell between the front end and the rear end of the second metallic shell stepped portion, it becomes possible to enlarge the gap between the front end side of the metallic shell and the front end side of the insulator while attaining a sufficient width of the front end surface of the metallic shell, thus making it possible to prevent the internal firing.

Further, according to the spark plug of the present invention, the second insulator stepped portion forms an included angle of 10° or more with a line parallel with the axis, a large gap can be attained between the front end side of the metallic shell and the front end side of the insulator. Accordingly, the interior jumping due to carbon adhered to the front end side of the insulator can be further hard to be caused.

Further, according to the spark plug of the present invention, since the rear end of the second insulator stepped portion is axially disposed at a more front end side than the first insulator stepped portion by an amount ranging from 1 to 6 mm, it becomes possible to adjust the length of an insulator leg portion formed over the distance from the axially front end portion of the insulator to the packing. Accordingly, an amount of heat radiated from an insulator base portion to the inner circumferential surface of the metallic shell can be adjusted and the thermal value (heat radiation rate) can be adjusted suitably.

Further, according to the spark plug of the present invention, since the rear end of the second insulator stepped portion is axially apart from the front end surface of the metallic shell by 7 mm or more, a further excellent internal firing preventing effect can be attained.

Further, according the spark plug of the present invention, since the rear end of the second insulator stepped portion is axially apart from the rear end of the second metallic shell stepped portion as a starting point by an amount ranging from −0.5 to 3 mm wherein the amount apart from the starting point toward the front end side is designated by a positive value, a sufficient amount of heat radiation from the heated insulator to the metallic shell can be obtained. Accordingly, the area of the inner circumferential surface of the metallic shell base portion can be made sufficiently large, thus making it possible to obtain a sufficient amount of heat radiation from the insulator to the metallic shell and improve the heat resistance. Further, since intrusion of unburnt gas into the engagement gap between insulator and the metallic shell can be prevented further assuredly, fouling of the front end side portion of the insulator can be prevented further assuredly and the interior firing due to carbon adhered to the front end side of the insulator becomes further hard to be caused.

Further, according to spark plug of the present invention, since the packing is made of a material having a thermal conductivity of 200 W/m·k or more, the heat of the heated insulator is transmitted by radiation to the metallic shell by way of the packing. Accordingly, it becomes possible to improve the heat resistance of the spark plug.

Further, according to the spark plug of the present invention, the nominal designation of the metallic shell is M12 or less. By this, a packing having a high thermal conductivity is disposed inside the metallic shell, the nominal designation of the thread portion of which is M12 or less. Accordingly, since a spark plug of a smaller nominal designation of screw thread causes the temperature of its front end portion to rise more rapidly as compared with a spark plug of a larger nominal designation of screw thread, a heat removal effect by the packing can be obtained largely.

Further, according to the spark plug of the present invention, since the axial length from the front end of the thread portion to the front end of the metallic shell is 2.5 mm or more, the front end side of the metallic shell protrudes into the combustion chamber of the cylinder head.

Further, according to the spark plug of the present invention, since the distance from the front end of the metallic shell to the most front end side engagement position of the packing and the first insulator stepped portion is 2 mm or more, it becomes possible to prevent the metallic shell from being excessively heated at the front end side and improve the heat resistance.

Further, since the front end of the insulator is positioned between the first insulator stepped portion and the second insulator stepped portion, the edge formed at the joint between the center electrode maximum diameter portion and the second center electrode stepped portion, can be positioned axially at a more rear end side than the front end of the insulator. Accordingly, since the edge is disposed inside the front end portion of the insulator even when the center electrode smaller diameter portion and the second center electrode stepped portion are fouled, it becomes possible to prevent a spark from jumping from the edge as a base point to the ground electrode to cause leakage of electricity to the outer peripheral surface of the insulator. Further, since a spark jumping to the edge is not produced even when the center electrode smaller diameter portion is made smaller in diameter for thereby making higher the electric field strength with a view to improving the sparking performance, the leakage phenomenon of the spark plug can be prevented.

DETAILED DESCRIPTION OF THE INVENTION

Figure 1:
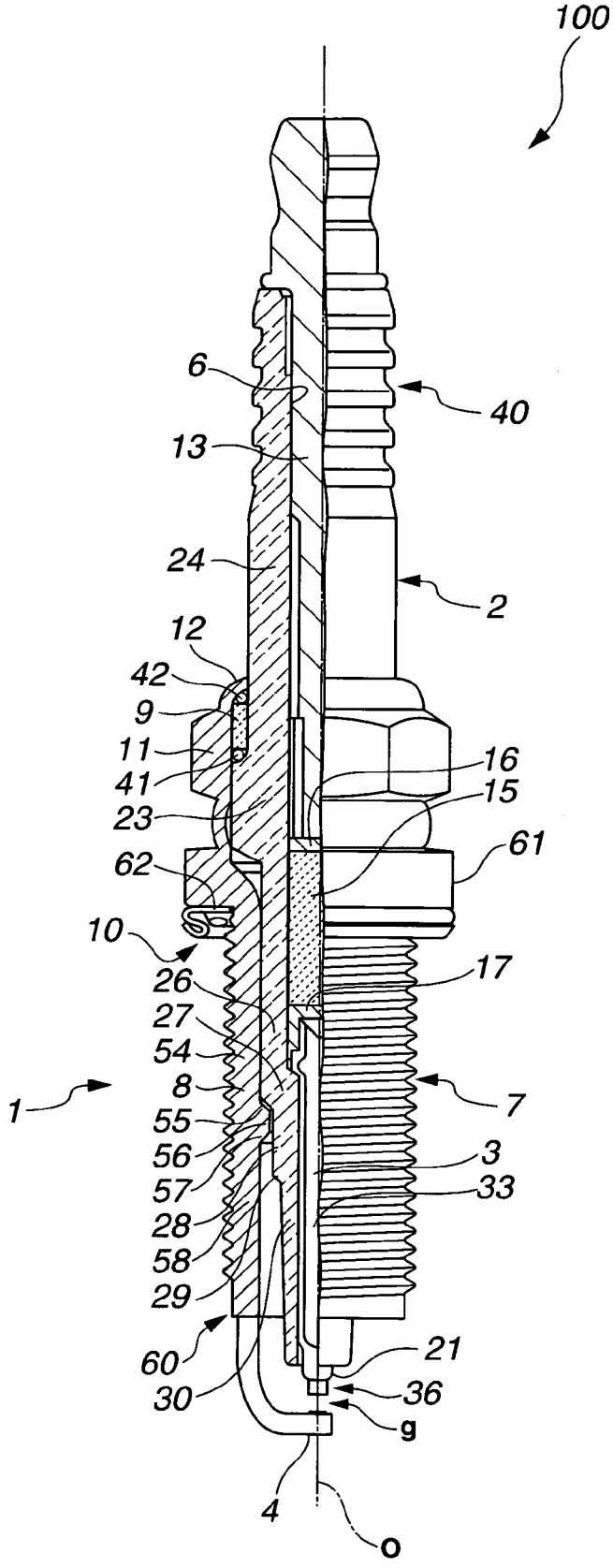
FIG. 1 is a longitudinal partially sectional view of a spark plug 100 according to an embodiment of the present invention.
Figure 2:
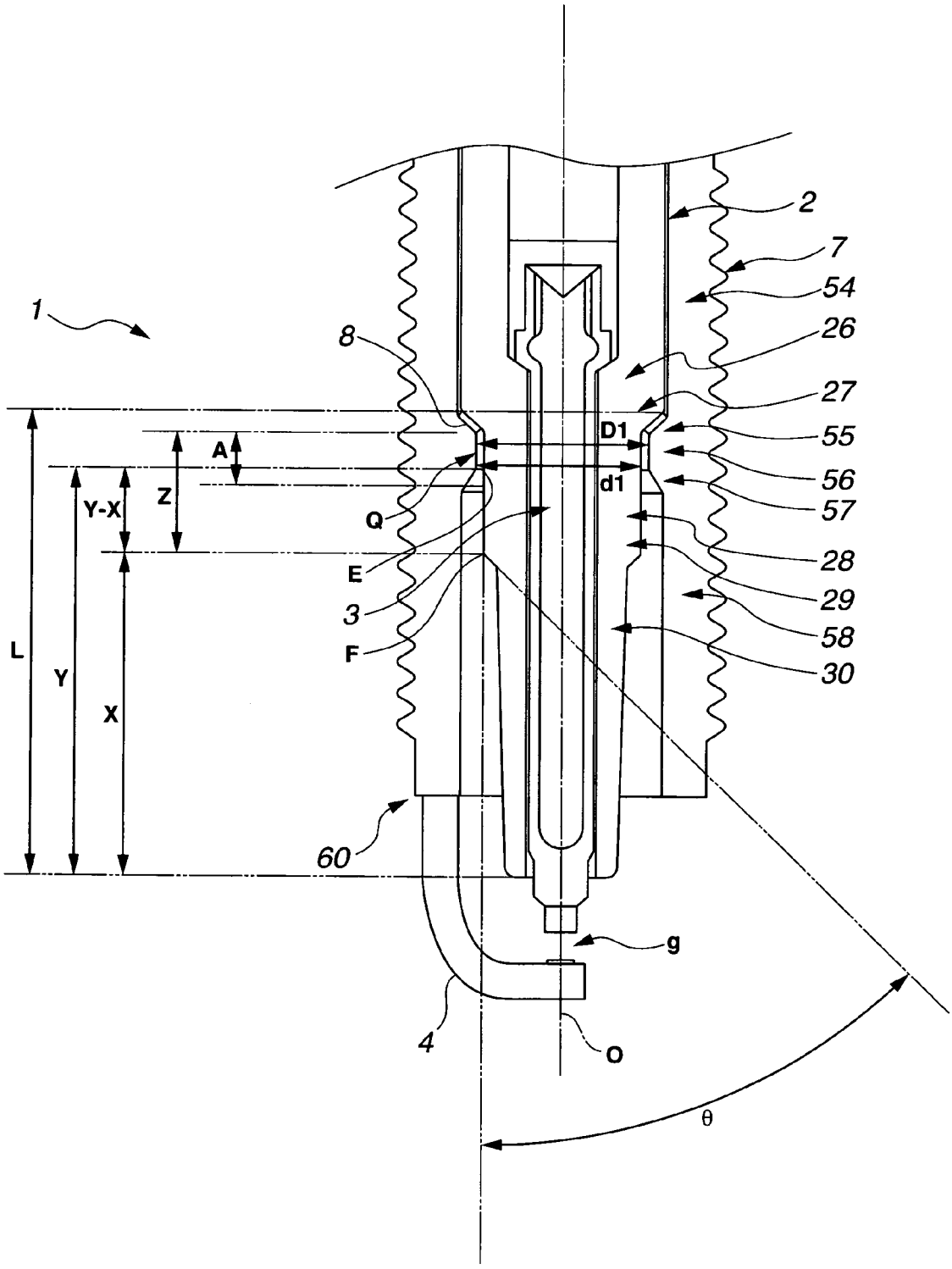
FIG. 2 is an enlarged, partial, longitudinal sectional view of a front end side principal portion of the spark plug 100 of FIG. 1.
Figure 3:
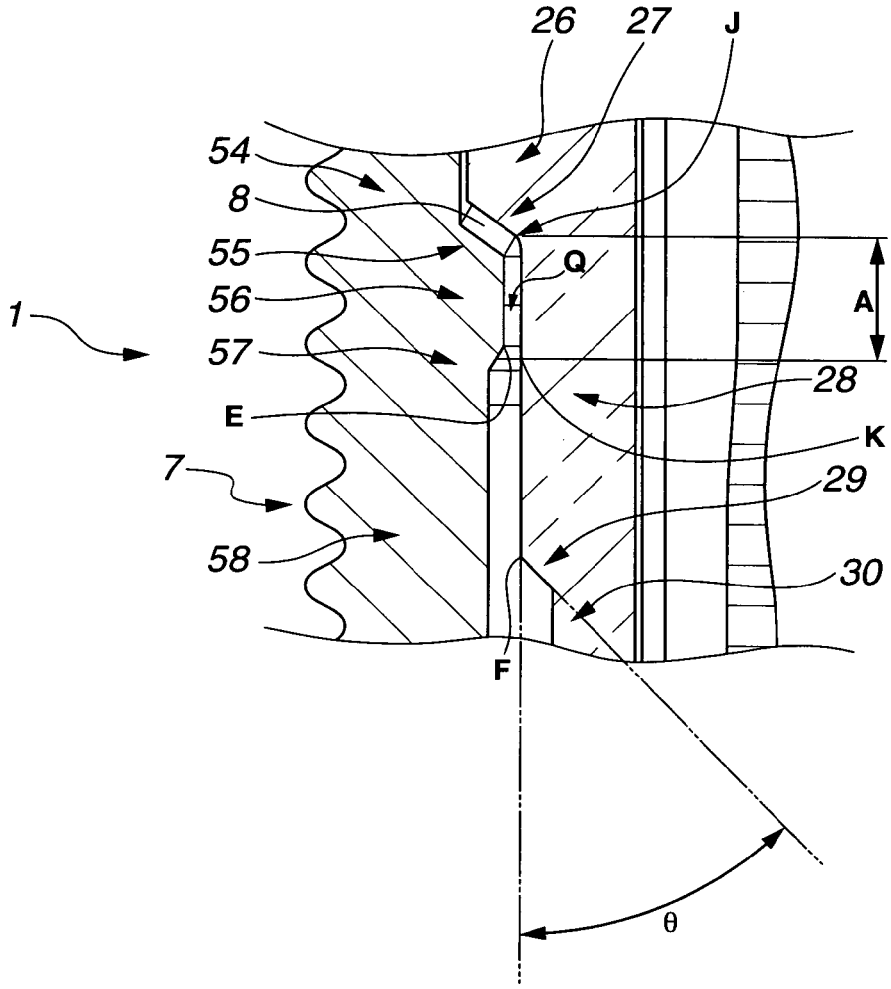
FIG. 3 is a fragmentary enlarged view of a plate packing 8 and its adjacent portion of FIG. 2.

Hereinafter, a spark plug 100 according to a first embodiment of the present invention will be described with reference to drawings. FIG. 1 is a longitudinal partially sectional view of the spark plug 100 according to the first embodiment of the present invention. FIG. 2 is a fragmentary longitudinal sectional view showing, in an enlarged scale, the front end side principal portion of the spark plug 100 of FIG. 1. FIG. 3 is an enlarged, fragmentary sectional view of a plate packing 8 and its adjacent portion. The spark plug 100 is used as a plug for ignition in an internal combustion engine such as an automotive gasoline engine. In the meantime, in the following description, an axis (one-dot chain line in FIGS. 1 and 2) of the spark plug 100 configured to have a rod-like shape is designated as "axis O". Further, in FIGS. 1 to 3, the lower side of the figure is designated as a front end side of the spark plug 100 and the upper side of the figure is designated as a rear end side of the spark plug 100.

Referring first to FIG. 1, brief description will be made as to the structure of the spark plug 100. As shown in FIG. 1, the spark plug 100 includes a nearly tubular metallic shell 1, a nearly tubular insulator 2 disposed inside the metallic shell 1 and supported thereby in a way as to protrude from a front end surface 60 of the metallic shell 1, a nearly rod-shaped center electrode 3 disposed in a through hole 6 of the insulator 2 in a way as to allow an electrode front end portion 36 to protrude therefrom, a ground electrode 4 having an end welded to the front end surface 60 of the metallic shell 1 and the other end bent in the lateral direction so as to dispose an inner side surface thereof opposite to the electrode front end portion 36 of the center electrode 3, etc. Further, as shown in FIGS. 1 and 2, between the ground electrode 4 and the electrode front end portion 36 of the center electrode 3 is formed a spark discharge gap g. Further, in a main body of the center electrode 3 is embedded a core member 33 composed of Cu (copper) or Cu alloy for acceleration of radiation. Further, in the through hole 6 of the insulator 2 and at a rear end side thereof (an upper end side in FIG. 1) is disposed a nearly rod-shaped terminal member 13. In the meantime, since the core member 33 of copper is embedded deeply in an interior of the center electrode 3, the spark plug 100 is strong against "heating" and can be used as a spark plug of the type that can be used over a wide temperature range.

Then, the metallic shell 1 will be described. As shown in FIG. 1, the metallic shell 1 is made of metal such as low carbon steel and formed into a tubular shape to constitute a housing of the spark plug 100. At the front end side outer circumferential surface of the metallic shell 1 is formed a thread portion 7 for attachment to an unshown engine head. As an example of the thread portion 7 can be used M10, M12 or M14 according to the standards. In the meantime, the nominal designation of the thread portion 7 herein used is what is prescribed in ISO2705 (M12), ISO2704 (M10), etc. and it is natural that a variation of the thread portion within a range of tolerance prescribed in the standards is admitted. Further, at the rear end portion in the direction of the axis O of the metallic shell 1 is formed a tool engagement portion 11 with which a tool such as a spanner or wrench is engaged by accessing thereto from the outside at the time of attachment of the metallic shell 1 to the engine head. In the meantime, the tool engagement portion 11 is hexagonal in section made by a plane extending across the axis O at right angles.

Further, as shown in FIGS. 1 and 2, at a more front end side than the tool engagement portion 11 of the metallic shell 1 is formed a metallic shell base portion 54, and at the front end side of the metallic shell base portion 54 in the direction of the axis O are formed a metallic shell smaller diameter portion 56 protruding radially inward of the metallic shell 1 and a first metallic shell stepped portion 55 connecting between the metallic shell smaller diameter portion 56 and the metallic shell base portion 54. Further, at the front end side of the metallic shell smaller diameter portion 56 are formed a metallic shell larger diameter portion 58 of an inner diameter intermediate between those of the metallic shell base portion 54 and the metallic shell smaller diameter portion 56 and a second metallic shell stepped portion 57 connecting between the metallic shell smaller diameter portion 56 and the metallic shell larger diameter portion 58. Accordingly, the metallic shell base portion 54, the first metallic shell stepped portion 55, the metallic shell smaller diameter portion 56, the second metallic shell stepped portion 57 and the metallic shell larger diameter portion 58 are formed in this order in the direction of the axis O from the tool engagement portion 11 of the metallic shell 1 to the front end. In the meantime, the first metallic shell stepped portion 55 is a portion for engagement with a first insulator stepped portion 27 of the insulator 2 which will be described later. Further, as shown in FIG. 1, at an intermediate portion of the metallic shell 1 in the direction of the axis O is formed a flange portion 61 protruding radially outward. Adjacent the rear end side (the upper end portion in FIG. 1) of the thread portion 7 in the direction of the axis O, i.e., on a seating surface 62 of the flange 61 is disposed a gasket 10.

Then, the insulator 2 will be described. As shown in FIG. 1, the insulator 2 is nearly tubular for holding therewithin the center electrode 3. The insulator 2 is formed of alumina or the like by firing, as is well known. As shown in FIG. 1, in the insulator 2 is formed a through hole 6 along the direction of the axis O of the spark plug 100. Further, into the rear end portion of the through hole 6 is inserted the nearly rod-shaped terminal member 13. The center electrode 3 has at least at a surface layer portion an electrode parent metal 21 composed of Ni (nickel) alloy such as Inconel (trade name) 600 or 601.

Further, a resistor 15 is disposed in the through hole 6 at a location between the inserted terminal member 13 and the center electrode 3. Further, at the front end portion and the rear end portion of the insulator 15 are disposed electrically conductive glass seal layers 16 and 17, respectively. By way of the glass seal layers, the center electrode 3 and the terminal member 13 are electrically connected to each other. In the meantime, the insulator 15 and the electrically conductive glass seal layers 16 and 17 constitute a sintered electrically conductive material portion. In the meantime, the resistor 15 is comprised of a resistor composition constituted by using a mixture of glass powder and electrical conductive material powder (and ceramic powder other than glass powder according to the necessity) as a raw material. Further, to the rear end portion of the terminal member 13 in the direction of the axis O is connected a high voltage cable (not shown) by way of a plug cap (not shown) to apply thereto a high voltage.

Further, as shown in FIG. 1, at an intermediate portion of the insulator 2 in the direction of the axis O is formed a flange-shaped protruded portion 23 protruding radially outward from an outer circumferential surface of the insulator 2. As shown in FIGS. 1 and 2, at the rear end side of the protruded portion 23 in the direction of the axis O of the insulator 2 is formed an insulator rearward portion 24. On the other hand, at a more front end side than the protruded portion 23 is formed an insulator larger diameter portion 26. At the front end side of the insulator larger diameter portion 26 are formed an insulator intermediate diameter portion 28 smaller in the outer diameter than the insulator larger diameter portion 26 and a first insulator stepped portion 27 connecting between the insulator intermediate diameter portion 28 and the insulator larger diameter portion 26 to form a radial stepped portion. Further, at a more front end side than the insulator intermediate diameter portion 28 are formed an insulator front end portion 30 that is smaller in diameter than the insulator intermediate diameter portion 28 and reduces in diameter toward the front end side and a second insulator stepped portion 29 connecting between the insulator front end portion 30 and the insulator intermediate diameter portion 28 to form a radial stepped portion.

As shown in FIG. 1, the insulator 2 is inserted into the metallic shell 1 through a rear end side (upper side in FIG. 1) opening portion and adapted so that the first insulator stepped portion 27 of the insulator 2 engages the first metallic shell stepped portion 55 of the metallic shell 1. Further, as shown in FIGS. 1 and 2, between the first metallic shell stepped portion 55 of the metallic shell 1 and the first insulator stepped portion 27 is disposed a nearly ring-shaped plate packing 8. By engagement of the first insulator stepped portion 27 and the first metallic shell stepped portion 55 by way of the plate packing 8, removal of the insulator 2 through movement in the direction of the axis O is prevented. Further, between the opening portion inner surface at the rear end side of the metallic shell 1 and the outer circumferential surface of the insulator 2 is disposed a nearly ring-shaped packing 41 engaging the rear side circumferential periphery of the protruded portion 23. At the further rearward side (upper side in FIG. 1) of the packing is disposed a filler layer 9 such as talc. By pushing the insulator 2 into the metallic shell 1 in the direction of the axis O and toward the front end side and caulking, under this condition, in a way as to drive the opening circumferential peripheral portion of the metallic shell 1 toward the packing 42, a caulked portion 12 is formed and the metallic shell 1 is fixed to the insulator 2.

Further, as shown in FIG. 1, on the rear end side outer circumferential surface of the insulator rearward portion 24 of the insulator 2 is formed a corrugated portion 40 having a section of a waved shape, which section is made by a plane including the axis of the insulator 2. The corrugated portion 40 provides a waved shape to the outer circumferential surface of the insulator 2 thereby increasing the area of the outer circumferential surface of the insulator 2. Accordingly, in case, for example, leaked electricity flows along the outer circumferential surface of the insulator to cause leakage (leakage phenomenon), the electricity is caused to disappear during flowing along the outer circumferential surface of the insulator 2 and therefore an effect of preventing leakage can be attained.

Then, description will be made as to the ground electrode 4. The ground electrode 4 is made of metal having a high corrosion resistance, for example, Ni alloy such as Inconel (trade name) 600 or 601. The ground electrode 4 is nearly rectangular in cross section made by a plane crossing the longitudinal direction thereof at right angles and has a bent rectangular bar-like external shape. As shown in FIG. 1, an end of the rectangular bar is connected to the front end surface 60 of the metallic shell 1 by welding or the like. On the other hand, the other end of the ground electrode 4 is bent laterally so as to face the electrode front end portion 36 of the center electrode 3 and in the direction of the axis O thereby forming a spark discharge gap g between the opposed surfaces of the center electrode 3 and the ground electrode 4.

Then, description will be made as to a gap width (clearance) β between the insulator 2 and the metallic shell 1 with reference to FIGS. 2 and 3. As shown in FIGS. 2 and 3, between the insulator 2 and the metallic shell 1 and at a more front end side than the plate packing 8 is formed a space Q. In the spark plug 100 of the first embodiment, let d1 denotes the outer diameter of the insulator at a more front end side than the first insulator stepped portion 27 and D1 denotes the metallic shell at a more front end side than the first metallic shell stepped portion 55, the space Q adjusted so that the clearance β=(D1−d1) is less than 0.45 mm has a predetermined length A.

For this reason, in case the spark plug is used in an environment where fouling is liable to be caused, for example, at pre-delivery, intrusion of unburnt gas into the space Q can be prevented assuredly. This can prevent carbon from adhering to the surface of the insulator 2 to foul it. Further, as shown in FIGS. 2 and 3, since the insulator intermediate diameter portion 28 and the metallic shell smaller diameter portion 56 are positioned so close to each other so that a gap therebetween is less than 0.45 mm, the heat of the heated insulator 2 is readily transmitted from the insulator intermediate diameter portion 28 to the metallic shell smaller diameter portion 56 of the metallic shell 1 by way of the space Q. Accordingly, removal of heat of the spark plug 100 is performed efficiently, thus making it possible to improve the heat resistance of the spark plug 100. Further, by the adjustment for making the space Q smaller, the spark plug 100 can be small-sized. In the meantime, confirmation of the effect attained by adjustment of the clearance β of the space Q will be described later.

Then, description will be made as to the length A over which the clearance β of the space Q is provided, with reference to FIGS. 2 and 3. As shown in FIG. 2, in the space Q, the length A over which the clearance adjusted to less than 0.45 mm is attained, is adjusted to 1.2 mm or more (preferably, 1.5 mm or more). In this connection, the starting point of the length A over which the clearance β is to be attained in the space Q, is a most front end side engagement position J of the plate packing 8 and the first insulator stepped portion 27 as shown in FIG. 3.

Since as shown in FIG. 2, the length A over which the clearance β of the space Q is attained is adjusted to 1.2 mm or more (preferably, 1.5 mm or more), the heat of the heated insulator 2 is transmitted efficiently to the metallic shell smaller diameter portion 56 by way of the space Q. For example, in case the length A over which the clearance β of less than 0.45 mm is attained is less than 1.2 mm, it is difficult for the heat radiated from the insulator intermediate diameter portion 28 to be transmitted sufficiently to the inner circumferential surface of the metallic shell 1 by way of the space Q. Accordingly, removal of heat of the spark plug 100 becomes worse, thus causing the temperature of the front end portion of the spark plug to become higher and causing a possibility of pre-ignition to become higher. Further, the finishing point of the length A over which the clearance β of the space Q is to be attained is positioned so as to be 7.9 mm or more (preferably, 9.9 mm or more) away from the front end surface 60 of the metallic shell 1 toward the rear end side. By this, a sufficient gap between the metallic shell 1 and the insulator 2 can be attained over the length of 7.9 mm or smaller (preferably, 9.9 mm or smaller) from the front end surface 60 of the metallic shell 1, so that the internal firing that is a spark discharge caused between the metallic shell 1 and the insulator 2 by way of the space Q is hard to be caused. In the meantime, confirmation of the effect of adjustment of the length A over which the clearance β of the space Q is attained will be described later.

Then, description will be made as to the angle θ between the insulator intermediate diameter portion 28 and the second insulator stepped portion 29 of the insulator 2 will be described. As shown in FIGS. 2 and 3, it is assumed that when observed in a section made by a plane including the axis O, θ is an angle between the imaginary line extending from the outer circumferential surface of the insulator intermediate portion 28 of the insulator 2 toward the front end side and the second insulator stepped portion 29. In this connection, since the outer circumferential surface of the insulator intermediate diameter portion 28 is parallel with the axis O, the angle θ indirectly represents the angle between the axis O and the second insulator stepped portion 29. In the spark plug 100 of the first embodiment, the angle θ is adjusted to 10° or more. By adjusting the angle θ to 10° or more, a large space can be attained between the metallic shell larger diameter portion 58 and the insulator smaller diameter portion 30. Accordingly, it becomes possible to prevent the internal firing that is a spark discharge between the metallic shell 1 and the insulator 2. On the other hand, when the angle θ is adjusted to less than 10°, the above-described effect cannot be attained. In the meantime, confirmation of effect attained by adjustment of the angle θ between the imaginary line formed by extending the outer circumferential surface of the insulator intermediate portion 28 of the insulator 2 toward the front end side and the second insulator stepped portion 29 will be described later.

Further, as shown in FIG. 3, the diametrical difference of the second insulator stepped portion 29, i.e., the difference in the outer diameter between the front end and the rear end of the second insulator stepped portion 29 is set larger than the diametrical difference of the second metallic shell stepped portion 57, i.e., the difference in the inner diameter between the front end and the rear end of the second metallic shell stepped portion 29. By such design, the space between the inner circumferential surface of the metallic shell 1 and the outer circumferential surface of the insulator 2 can be increased without decreasing the width of the front end surface 60 of the metallic shell 1 as much as possible.

Then, the length Z of the insulator intermediate portion 28 in the direction of the axis O will be described. As shown in FIGS. 1 and 2, at the front end side of the first insulator stepped portion 27 of the insulator 2 is formed the second insulator stepped portion 28. When observed in a section made by a plane including the axis O as shown in FIG. 2, the outer circumferential surface of the insulator intermediate diameter portion 28 extends in parallel with the axis O. Further, in the spark plug 100 of the first embodiment, assuming that Z is the axial length of the insulator intermediate diameter portion 28, the length Z of the insulator intermediate diameter portion 28 is adjusted so as to be in the range from 1.0 to 6.0 mm. Namely, the axial distance between the front end of the first insulator stepped portion and the rear end (F) of the second insulator stepped portion is in the range from 1.0 to 6.0 mm. For this reason, the thermal value (heat radiation rate, removal of heat) of the spark plug 100 is adjusted and it becomes possible to improve the heat resistance and the fouling resistance. For example, if the length Z of the insulator intermediate portion 28 exceeds 6.0 mm, the internal firing that is caused by carbon adhered to the front end side of the insulator 2 is liable to be caused. Further, if the length Z is less than 1.0 mm, the temperature of the front end portion of the spark plug becomes higher such that the heat resistance is largely deteriorated since the removal of heat becomes worse (the thermal value is lowered) though the fouling resistance is increased. In the meantime, recognition of the effect attained by adjustment of the length Z of the insulator intermediate portion 28 will be described later.

Then, description will be made as to the relative position between the insulator intermediate diameter portion 28 of the insulator 2 and the metallic shell smaller diameter portion 56 of the metallic shell 1. First, it is assumed that when observed in a section made by a plane including the axis O as shown in FIGS. 2 and 3, E denotes the intersecting point of the metallic shell smaller diameter portion 56 of the metallic shell 1 and the second metallic shell stepped portion 57, i.e., the rear end of the second metallic shell stepped portion 57, and F denotes the intersecting point of the insulator intermediate diameter portion 28 of the insulator 2 and the second insulator stepped portion 29, i.e., the rear end of the second insulator stepped portion 29. Further, it is assumed that Y mm is the distance from the front end of the insulator 2 to the intersecting point E and in parallel with the axis O and X mm is the distance from the front end of the insulator 2 to the intersecting point E and in parallel with the axis O. Then, it is assumed that (Y-X) mm is the distance between the intersecting points E and F and in parallel with the axis O. When the intersecting point E, the intersecting point F, the length X, the length Y and the distance (Y-X) mm are assumed as described above, the distance (Y-X) is adjusted so as to be in the range from −0.5 to 3 mm.

By adjusting the distance (Y-X) so as to be in the range from −0.5 to 3 mm, the amount of heat transmitted from the heated insulator 2 to the metallic shell 1 side is adjusted suitably. For example, if the distance (Y-X) assumes a large minus value, the intersecting point F is positioned at the upper side (upper side in FIG. 2) of the intersecting point E, thus decreasing the area of the insulator intermediate diameter portion 28 of the insulator 2, which is opposite to the metallic shell smaller diameter portion 56 of the metallic shell 1 to make the removal of heat of the spark plug 100 worse. Thus, the temperature at the front end side of the spark plug 100 rises, thus causing considerable deterioration of the heat resistance, such as occurrence of pre-ignition. On the other hand, if the length (X-Y) is too long, the length of the insulator intermediate diameter portion 28 in the direction of the axis O is increased such that the internal firing due to carbon adhering to the front end side of the insulator 2 is liable to be caused. Accordingly, by adjusting the distance (X-Y) so as to be in the range from −0.5 to 3 mm, the heat resistance of the spark plug 100 can be improved together with the fouling resistance. In the meantime, the effect attained by the adjustment of the distance (Y-X) will be described later.

Then, description will be made as to the plate packing 8 with reference to FIGS. 2 and 3. As described above, the plate packing 8 that is nearly ring-shaped when observed in plan, is disposed in a space between the first insulator stepped portion 27 and the first metallic shell stepped portion 55. As a material of the plate packing 8 is used, for example, a material having a high heat conductivity such as copper. If the heat conductivity of the plate packing 8 is high, the heat of the insulator 2 is transmitted to the first insulator stepped portion 55 of the insulator 1 efficiently, thus causing removal of heat of the spark plug 100 to become good and making it possible to improve the heat resistance. In the meantime, more specifically, the material of the plate packing 8 is preferably a material having a heat conductivity of 200 W/m·k or higher. Further, as a material of the plate packing 8 can be used a material other than copper (for example, aluminum, etc.). In the meantime, description as to recognition of the effect attained by the material of the plate packing 8 will be made later.

Further, the plate packing 8 having a high heat conductivity as described above produces a particularly high effect on the heat resistance of the spark plug 100, the designation of the thread portion 7 of which is M12 or smaller (for example, M10 and M12), as compared with the case where a conventional soft steel packing is used. This is because in case of the spark plug 100, the designation of screw thread of which is small, i.e., M12 or smaller, the temperature rise of the front end portion of the spark plug is rapid as compared with the spark plug 100, the designation of screw thread of which is M14 for instance, such that the effect of removal of heat is further improved by using the plat packing 8 having a high heat conductivity (for example, copper packing). For this reason, by the spark plug 100, a large effect on improvement of the heat resistance can be attained. In the meantime, the effect on the heat resistance depending upon the material of the plate packing 8 and the difference of the designation of screw thread will be described later.

To recognize the effect attained by the limitations of the numerical values, which have been described as above according to the present invention, the performance test of the spark plug 100 of the first embodiment was made in the following manner. Then, the result of the performance test of examples 1 to 10 will be described in sequence with reference to the graphs of FIGS. 4 to 13.

EXAMPLE 1

Figure 4:
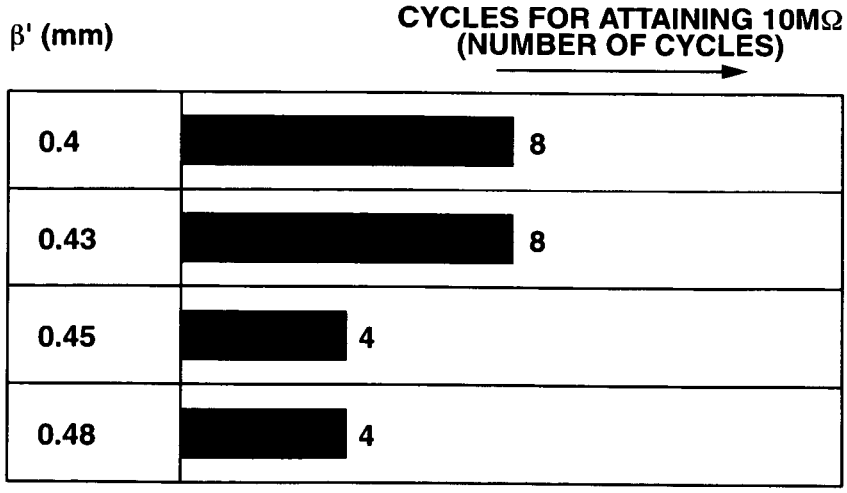
FIG. 4 is a graph showing the result of a pre-delivery test of the spark plug 100, depending upon a variation of a minimum clearance β'.

First, a pre-delivery test of the spark plug 100, depending upon a variation of the clearance β will be described with reference to FIGS. 2 to 4. FIG. 4 is a graph showing the result of the pre-delivery test of the spark plug 100 depending upon a variation of a minimum clearance β'. In the meantime, the test conditions of the pre-delivery test are as follows.

Ô Test Conditions of Pre-delivery Test

Engine: 4-cycle DOHC engine having a displacement 2.0 liters

Fuel: lead-free regular gasoline

Oil: 5W-30

Room temperature: −10° C.

Coolant temperature: −10° C.

Test pattern: JIS D1606 pattern ("method of testing the suitability of an automotive spark plug for use with an engine")

In the meantime, the pattern of JIS D1606 simulates travel for delivery of a vehicle in a cold season.

First, assuming that D'1 denotes the outer diameter of the metallic shell smaller diameter portion 56 shown in FIG. 2 and d'1 denotes the inner diameter of the insulator intermediate diameter portion 28, test examples of the spark plugs 100 in which the minimum clearances β' expressed by the following equation were set to 0.4, 0.43, 0.45 and 0.48, respectively, were prepared.

$$\beta'=(D'1-d'1)$$

The traveling pattern of the above-described JIS D1606 was repeated as a single cycle until the insulation resistance of the spark plug 100 became 10MΩ or less. The result is shown in the bar graph of FIG. 4. In the meantime, the length of the metallic shell smaller diameter portion 56 was 1.5 mm and the length from the J portion to the front end of the metallic shell 1 was 12.9 mm. The graph of FIG. 4 shows cycles for attaining 10MΩ (number of cycles) for each minimum clearance β' (mm).

Herein, the "cycles for attaining 10MΩ" in the pre-delivery test will be described. For example, the larger the number of cycles for attaining 10MΩ, the less carbon is adhered to the front end side of the insulator 2, making it possible to determine that the insulation ability of the insulator 2 is maintained and the fouling resistance is good. On the contrary, it can be determined that the less the number of the cycles, the lower the fouling resistance at the front end side of the insulator 2. Accordingly, in the following pre-delivery test, judgment was made based on such standard of judgment as described above.

As shown in FIG. 4, with the minimum clearance β'=0.4 mm, the number of cycles for attaining 10MΩ was 8. With the minimum clearance β'=0.43 mm, the number of cycles for attaining 10MΩ was 8. With the minimum clearance β'=0.45 mm, the number of cycles for attaining 10MΩ was 4. With the minimum clearance β'=0.48 mm, the number of cycles for attaining 10M was 4. From comparative observation of the data of FIG. 4, it was found that with β'=less than 0.45 mm, the number of cycles for attaining the 10MΩ was stably high, i.e., eight or more. On the contrary, with the minimum clearance β'=0.45 mm or more, the number of cycles for attaining 10MΩ was reduced, i.e., four. It is considered that this is because the minimum clearance β' was adjusted so as to be a little larger such that unburnt gas was intruded into the engagement space between the insulator 2 and the metallic shell 1 and the number of cycles for attaining 10MΩ were decreased. From the results described as above, it is considered that the clearance β of less than 0.45 mm makes it possible to improve the fouling resistance of the spark plug 100. Accordingly, it is judged that the clearance β is preferably less than 0.45 mm.

EXAMPLE 2

Figure 5:
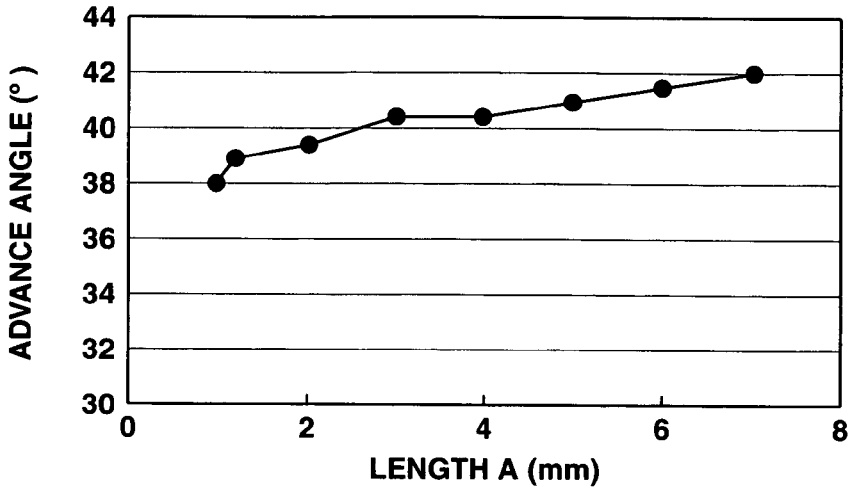
FIG. 5 is a graph showing the result of a heat resistance test of the spark plug 100, depending upon a variation of a length A of a clearance β.

Then, the result of a heat resistance test of the spark plug 100, depending upon a variation of the length A of the clearance β will be described with reference to FIGS. 2 to 5. FIG. 5 is a graph showing the result of the heat resistance test of the spark plug 100, depending upon a variation of the length A of the clearance β. In the meantime, the test conditions of the heat resistance test are as follows.

Ô Test Conditions of Heat Resistance Test

Engine: 4-Cycle DOHC Engine Having a Displacement 1.6 liters

Fuel: lead-free high octane gasoline

Room temperature/humidity: 20° C./60%

Oil temperature: 80° C.

Test pattern: engine speed of 5500 rpm, WOT (for two minutes)

WOT means wide open throttle.

Test examples of the spark plugs 100 in which the lengths A by which the clearance β was attained in the space Q were set to 1 to 7 mm, respectively, were prepared. The engine was operated with the above-described test pattern for the heat resistance test and a pre-ignition occurrence advance angle was measured. In the meantime, the length of the metallic shell smaller diameter portion 56 was 1.5 mm, the length from the J portion to the front end of the metallic shell 1 was 12.9 mm and the minimum clearance β' was 0.4 mm. The result is shown by the solid line in FIG. 5. In FIG. 5, the abscissa indicates the length A and the ordinate indicates the pre-ignition occurrence angle (°). In the meantime, the "pre-ignition occurrence angle" is herein intended to indicate the ignition advance angle at which pre-ignition (ignition at to fast timing) occurs.

Herein, "the pre-ignition occurrence angle being large" indicates that the heat resistance is high. Namely, in case of the spark plug with which pre-ignition is hard to be caused even when the ignition timing is advanced (made faster), the time during which the spark plug is exposed to a fresh mixture is relatively short and the time during which the spark plug is exposed to a combustion gas is relatively long such that the temperature of the front end of the spark plug is caused to rise. For this reason, the resistance to pre-ignition is called the heat resistance.

As shown by the solid line in FIG. 5, when A=1.0, the pre-ignition occurrence angle was 38.0°. When A=1.2 (mm), the pre-ignition occurrence angle was 39.0°. When A=2, the pre-ignition occurrence angle was 39.5°. When A=3 and 4, the pre-ignition occurrence angle was 40.5°. When A=5, the pre-ignition occurrence angle was 41°. When A=6, the pre-ignition occurrence angle was 41.5°. When A=7, the pre-ignition occurrence angle was 42°. When A=1.2 (mm) or more, the pre-ignition occurrence angle was represented by straight lines ascending rightward. Accordingly, by judging synthetically and relatively from the fact that the pre-ignition occurrence angle was decreased sharply when A=1.0 mm, it was determined that the heat resistance of the spark plug 100 was improved when A=1.2 mm or more.

EXAMPLE 3

Figure 6:
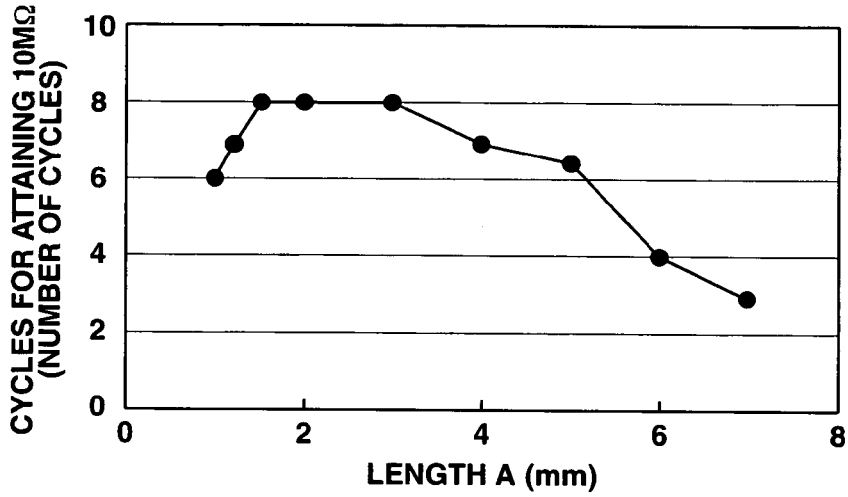
FIG. 6 is a graph showing the result of a pre-delivery test of the spark plug 100, depending upon a variation of the length A of the clearance β.

Then, the pre-delivery endurance test of the spark plug 100, depending upon a variation of the length A of the clearance β will be described with reference to FIGS. 2 to 6. FIG. 6 is a graph showing the result of the pre-delivery test of the spark plug 100, depending upon a variation of the length A of the clearance β.

In the pre-delivery test, test examples of the spark plug 100 in which the lengths A for obtaining the clearance of less than 0.45 mm were set to 1 to 7 mm, respectively, were prepared. The traveling pattern of the above-described JIS D1606 was repeated as a single cycle until the insulation resistance of the spark plug 100 became 10MΩ or less. The result is shown by the solid line in FIG. 6. In the meantime, the length of the metallic shell smaller diameter portion 56 was 1.5 mm, the length from the J portion to the front end of the metallic shell 1 was 12.9 mm, and the minimum clearance β' was 0.4 mm. In FIG. 6, the ordinate indicates the length A, and the abscissa indicates the number of cycles for attaining 10MΩ.

As shown in FIG. 6, when A=1, the number of cycles for attaining 10MΩ was 6. When A=1.2, the number of cycles for attaining 10MΩ was 7. When A=1.5, the number of cycles for attaining 10MΩ was 8. When A=2, the number of cycles for attaining 10MΩ was 8. When A=3, the number of cycles for attaining 10MΩ was 8. When A=4, the number of cycles for attaining 10MΩ was 7. When A=5, the number of cycles for attaining 10MΩ was 6.5. When A=6, the number of cycles for attaining 10MΩ was 4. When A=7, the number of cycles for attaining 10MΩ was 3. The solid line in the graph has a nearly parabola. By judging, on the basis of the result of the example 2 (refer to FIG. 5), the result of FIG. 6 when the length A=1.2 mm or more, it was found that the number cycles for attaining 10MΩ was stably six or more when the length A=5 mm or less (i.e., the finishing point K of the length A for attaining the clearance β of the space Q is 7.9 mm or more from the front end face 60 of the metallic shell 1) but the number of cycles for attaining 10MΩ was rapidly decreased to four when the length A=6 mm or more. Accordingly, it was determined that the fouling resistance was improved when the finishing point K for attaining the clearance β of the space Q was 7.9 mm or more from the front end surface 60 of the metallic shell 1. Further, when the length A is in the range from 1.5 to 3 mm (i.e., the finishing point K of the length A for attaining the clearance β of the space Q is 9.9 mm or more from the front end face 60 of the metallic shell 1), the number of cycles for attaining 10MΩ was eight, i.e., assumed a high value, so that it was determined that the fouling resistance was further improved.

EXAMPLE 4

Figure 7:
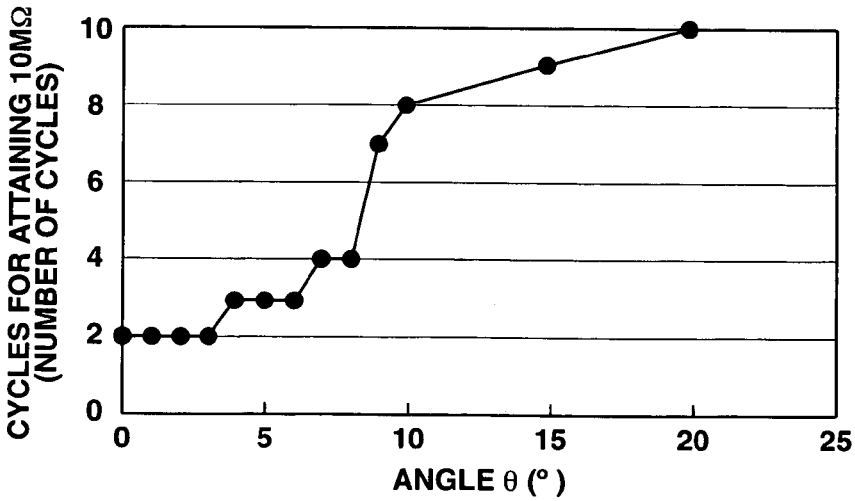
FIG. 7 is a graph showing the result of a pre-delivery test of the spark plug 100, depending upon a variation of an angle θ.

Then, the result of the pre-delivery test of the spark plug 100, depending upon a variation of the angle θ between the insulator intermediate diameter portion 28 and the second insulator stepped portion 29 will be described with reference to FIGS. 2 to 7. FIG. 7 is a graph showing the result of the pre-delivery test of the spark plug 100, depending upon a variation of the angle θ. Test examples of the park plugs 100, in which the angles θ between the insulator intermediate diameter portion 28 and the second insulator stepped portion 29 were adjusted so as to be in the range from 0 to 20°, were prepared. In the meantime, the test condition of the pre-delivery test was the same as described above. In the meantime, the minimum clearance β' was 0.4 mm, and the axial length A of the space Q was fixed at 3 mm.

As shown in FIG. 7, the number of cycles for attaining 10MΩ was 2 when the angle θ between the insulator intermediate diameter portion 28 and the second insulator stepped portion 29 was 0°, 1°, 2° and 3°, the number of cycles for attaining 10MΩ was 3 when θ=4°, 5° and 6°, the number of cycles for attaining 10MΩ was 4 when θ=7° and 8°, the number of cycles for attaining 10MΩ was 7 when θ=9°, the number of cycles for attaining 10MΩ was 8 when θ=10°, the number of cycles for attaining 10MΩ was 9 when θ=15°, and the number of cycles for attaining 10MΩ was 10 when θ=20°. As shown in the graph of FIG. 7, the solid line of the graph has a nearly S-like curved shape, and the number of cycles for attaining 10MΩ was eight or more, i.e., high when θ=10° or more. Accordingly, by relatively judging the result of FIG. 7, it was determined that the fouling resistance of the spark plug 100 could be improved when the angle θ between the insulator intermediate diameter portion 28 and the second insulator stepped portion 29 was 10° or more.

EXAMPLE 5

Figure 8:
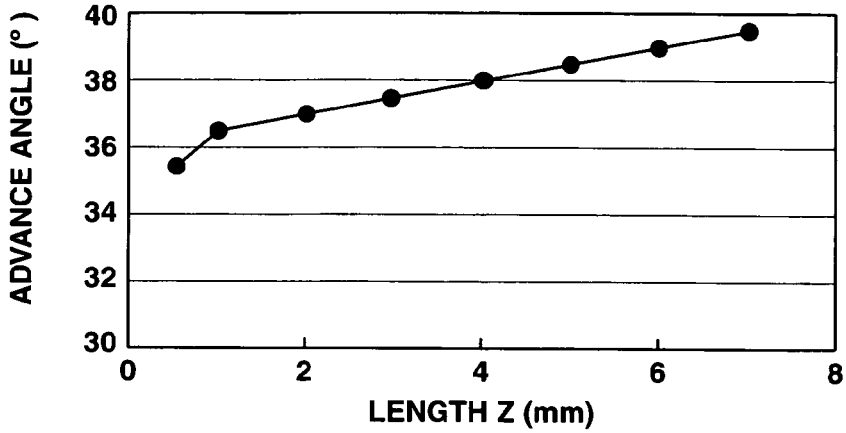
FIG. 8 is a graph showing the result of a heat resistance test of the spark plug 100, depending upon a variation of the length Z.

Then, the heat resistance test of the spark plug 100, depending upon a variation of the length Z of the insulator intermediate diameter portion 28 in parallel with the direction of the axis O will be described with reference to FIGS. 2 to 8. FIG. 8 is a graph showing the result of the heat resistance test on the basis of the length Z. Test examples of the spark plug, in which the lengths Z of the insulator intermediate diameter portion 28 in parallel with the direction of the axis O were set so as to be in the range from 0.5 to 7 mm were prepared. The engine was operated with the above-described test pattern of the heat resistance test and the pre-ignition occurrence advance angle was measured. The result is shown by the solid line in FIG. 8. In the meantime, the length of the metallic shell intermediate diameter portion 56 was 1.5 mm, the length from the J portion to the front end of the metallic shell 1 was 12.9 mm, the minimum clearance β' was 0.4 mm and the length A of the space Q in parallel with the direction of the axis O was fixed at 3 mm. In FIG. 8, the abscissa indicates the length of the Z portion and the ordinate indicates the pre-ignition occurrence advance angle (°) for the spark plug 100 having each length of the Z portion. In the meantime, the test condition of the heat resistance test was the same as described above.

As shown in FIG. 8, the pre-ignition occurrence angle was 35.5° when the length Z of the insulator intermediate diameter portion 28 in parallel with the direction of the axis O was 0.5 mm, the pre-ignition occurrence angle was 36.5° when Z=1 mm, the pre-ignition occurrence angle was 37° when Z=2 mm, the pre-ignition occurrence angle was 37.5° when Z=3 mm, the pre-ignition occurrence angle was 38° when Z=4 mm, the pre-ignition occurrence angle was 38.5° when Z=5 mm, the pre-ignition occurrence angle was 39° when Z=6 mm, and the pre-ignition occurrence angle was 39.5° when Z=7 mm. As shown in FIG. 8, the solid line of FIG. 8 ascends rightward when Z=1 mm or more, and the pre-ignition occurrence angle is decreased rapidly when Z=0.5. Accordingly, it was determined that the heat resistance of the spark plug 100 could be improved when Z=1 mm or more.

EXAMPLE 6

Figure 9:
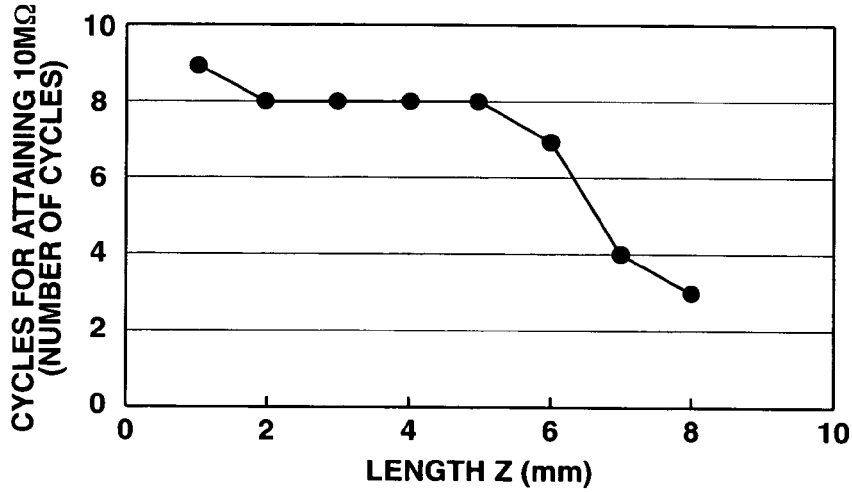
FIG. 9 is a graph showing the result of a pre-delivery test of the spark plug 100, depending upon a variation of the length Z.

Then, the heat resistance test of the spark plug 100 on the basis of the length Z of the insulator intermediate diameter portion 28 in parallel with the direction of the axis O will be described with reference to FIGS. 2 to 9. FIG. 9 is a graph showing the result of the heat resistance test on the basis of the length Z. Test examples of the spark plug, in which the length Z of the insulator intermediate diameter portion 28 in parallel with the direction of the axis O were set so as to be in the range from 1 to 8 mm were prepared. The result is shown by the solid line in FIG. 9. In the meantime, the length of the metallic shell intermediate diameter portion 56 was 1.5 mm, the length from the J portion to the front end of the metallic shell 1 was 12.9 mm, the minimum clearance β' was 0.4 mm and the length A of the space Q in parallel with the direction of the axis O was fixed at 3 mm. In the meantime, the test condition of the heat resistance test was the same as described above.

As shown in FIG. 9, the number of cycles for attaining 10MΩ was 9 when the length Z of the insulator intermediate diameter portion 28 in the direction of the axis O was 1 mm, the number of cycles for attaining 10MΩ was 8 when Z=2 to 5 mm, the number of cycles for attaining 10MΩ was 7 when Z=6 mm, the number of cycles for attaining 10MΩ was 4 when Z=7 mm, and the number of cycles for attaining 10MΩ was 3 when Z=8 mm. The solid line of FIG. 9 has an inverted S-like curved shape, and the number of cycles for attaining 10MΩ was six or more, i.e., a high fouling resistance was attained when Z=6 or less. On the other hand, the number of cycles for attaining 10MΩ was four or less, i.e., decreased rapidly when Z=7 and 8. Accordingly, it was determined that the fouling resistance could be improved when Z=6 mm or less. Thus, from the result of the Examples 5 and example 6, it was determined that the heat resistance and fouling resistance of the spark plug 100 could be improved when the length Z of the insulator intermediate diameter portion 28 was within the range from 1 to 6 mm.

EXAMPLE 7

Figure 10:
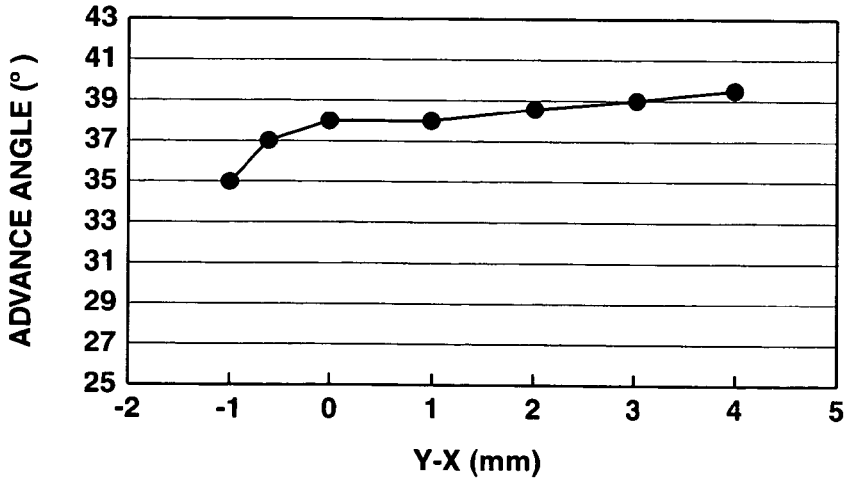
FIG. 10 is a graph showing the result of a pre-delivery test of the spark plug 100, depending upon a variation of a distance (X-Y).

Then, the heat resistance test of the spark plug 100, depending upon a variation of the distance (Y-X) between the intersecting points E and F will be described with reference to FIGS. 2 to 10. FIG. 10 shows the result of the heat resistance test of the spark plug 100, depending upon a variation of the distance (Y-X). Test examples of the spark plug 100 shown in FIG. 2, in which the distances (Y-X) were set in the range from −1 to 4 mm were prepared. The engine was operated with the above-described test pattern for the heat resistance test and the pre-ignition occurrence advance angle was measured. The result is shown by the solid line in FIG. 10. In the meantime, the length of the metallic shell intermediate diameter portion 56 was 1.5 mm, the length from the J portion to the front end of the metallic shell 1 was 12.9 mm, and the minimum clearance β' was 0.4 mm. The length A of the space Q in parallel with the direction of the axis O was fixed at 3 mm. In FIG. 10, the abscissa indicates the distance (Y-X) (mm) and the ordinate indicates the pre-ignition occurrence angle (°).

As shown in FIG. 10, the pre-ignition occurrence angle was 35.0° when the distance (Y-X) between the intersecting points E and F along the line parallel with the direction of the axis O was −1 mm, the pre-ignition occurrence angle was 37.0° when the distance (Y-X)=−0.5 mm, the pre-ignition occurrence angle was 38° when the distance (Y-X)=0 mm, the pre-ignition occurrence angle was 38.0° when the distance (Y-X)=1 mm, the pre-ignition occurrence angle was 38.5° when the distance (Y-X)=2 mm, the pre-ignition occurrence angle was 39.0° when the distance (Y-X)=3 mm, and the pre-ignition occurrence angle was 39.5° when the distance (Y-X)=4 mm. When the distance (Y-X)=−1 mm, the intersecting point F is positioned at the side closer to the rear end of the spark plug 100 shown in FIGS. 1 and 2 (at the upper side in FIGS. 1 and 2) than the intersecting point X. Accordingly, as shown in FIG. 2, the area of the insulator intermediate diameter portion 28 of the insulator 2, which is opposite to the metallic shell smaller diameter portion 56 of the metallic shell 1 becomes smaller such that removal of heat of the spark plug 100 becomes worse. Thus, the pre-ignition phenomenon or the like due to increase in the temperature of the front end side of the spark plug 100 is liable to be caused, and therefore the heat resistance becomes worse. Accordingly, it was determined that the heat resistance was improved when the distance (Y-X) was −0.5 mm or more.

Embodiment 8

Figure 11:
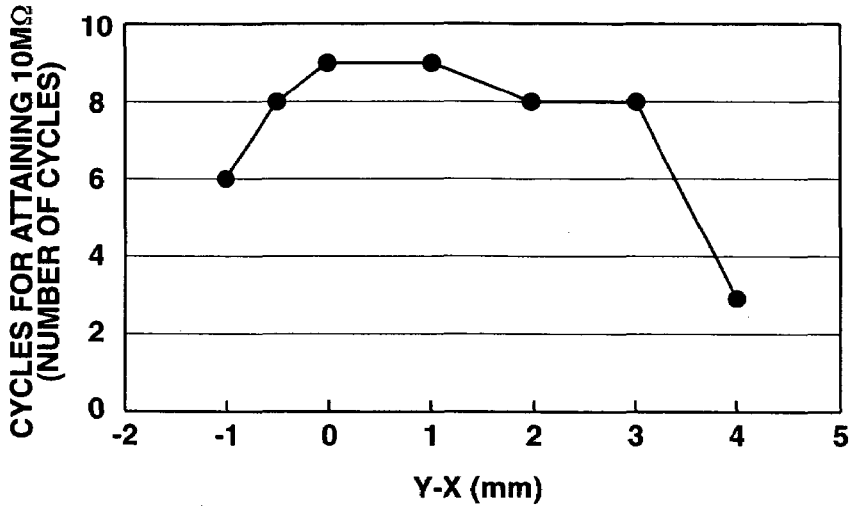
FIG. 11 is a graph showing the result of a pre-delivery test of the spark plug 100, depending upon a variation of the distance (X-Y).

Then, the result of the pre-delivery test of the spark plug 100, depending upon a variation of the distance (Y-X) between the intersecting points E and F will be described with reference to FIGS. 2 and 11. FIG. 11 is a graph showing the result of the pre-delivery test of the spark plug 100, depending upon a variation of the distance (Y-X). Test examples of the park plug 100 shown in FIG. 2, in which the distances (Y-X) were set in the range from −1 to 4, were prepared. The result of the test is shown by the solid line in FIG. 11. In the meantime, the test condition of the pre-delivery test was the same as described above. Further, the length of the metallic shell intermediate diameter portion 56 was 1.5 mm, the length from the J portion to the front end of the metallic shell 1 was 12.9 mm, and the minimum clearance β' was 0.4 mm. In FIG. 11, the abscissa indicates the distance (Y-X) (mm) and the ordinate indicates the number of cycles for attaining 10MΩ.

As shown in FIG. 11, the number of cycles for attaining 10MΩ was 6 when the distance (Y-X)=−1, the number of cycles for attaining 10MΩ was 8 when the distance (Y-X)=−0.5, the number of cycles for attaining 10MΩ was 9 when the distance (Y-X)=0, the number of cycles for attaining 10MΩ was 9 when the distance (Y-X)=1, the number of cycles for attaining 10MΩ was 8 when the distance (Y-X)=2, the number of cycles for attaining 10MΩ was 8 when the distance (Y-X)=3, and the number of cycles for attaining 10MΩ was 3 when the distance (Y-X)=4. As shown in the graph of FIG. 11, the solid line has a nearly convexly curved shape. Further, when the distance (Y-X)=4, the number of cycles for attaining 10MΩ was 3, i.e., the number of cycles for attaining 10MΩ was extremely small. It is presumed that this is because the distance (Y-X) became too long such that the length of the insulator intermediate diameter portion 28 in the direction of the axis O became longer and internal firing due to carbon adhered to the front end side of the insulator 2 became liable to be caused. Further, since the number of cycles for attaining 10MΩ was 8 even when the distance (Y-X)=−0.5, i.e., the fouling resistance was scarcely lowered, it was determined that the fouling resistance of the spark plug 100 could be improved when the distance (Y-X) was in the range from −0.5 to 3 mm. Accordingly, from the results of the Examples 7 and 8, it was determined that the heat resistance and the fouling resistance of the spark plug 100 could be improved when the distance (Y-X) was in the range from −0.5 to 3 mm.

EXAMPLE 9

Figure 12:
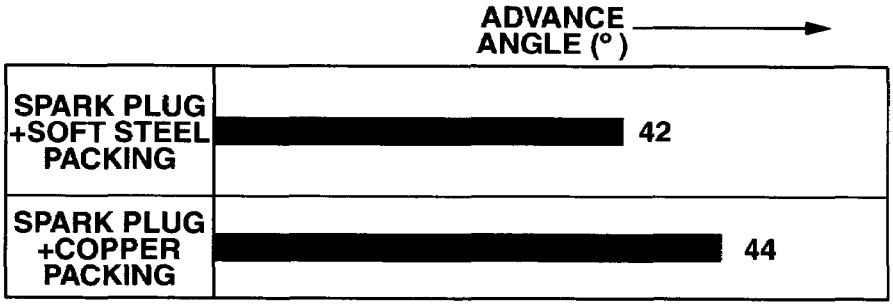
FIG. 12 is a graph showing the result of a heat resistance test of the spark plug 100 in which a copper packing is used as the plate packing 8 and the spark plug 100 in which a soft steel packing is used as the plate packing 8.

Then, the result of the heat resistance test of the spark plug 100 in which copper and soft steel are used as the material of the plate packing 8 will be described with reference to FIGS. 2 and 12. FIG. 12 is a graph showing the result of the heat resistance test of the spark plug 100 in which copper is used for the plate packing 8 and the spark plug 100 in which soft steel is used. Test examples of the spark plug 100, in which a conventional soft steel packing was used and the test examples of the spark plug 100, in which a copper packing was used, were prepared. The result of the test is shown by a bar graph in FIG. 12. In the meantime, the length of the metallic shell intermediate diameter portion 56 was 1.5 mm, the length from the J portion to the front end of the metallic shell 1 was 12.9 mm, and the minimum clearance β' was 0.4 mm. The length A of the space Q in parallel with the direction of the axis O is fixed at 3 mm. In the meantime, in FIG. 12, the abscissa indicates the pre-ignition occurrence advance angle. The test condition of the heat resistance test was the same as described above.

As shown in FIG. 12, the pre-ignition occurrence advance angle of the spark plug 100 in which the conventional soft steel packing was used, was 42°. In contrast to this, the pre-ignition occurrence advance angle of the spark plug 100 in which the copper packing was used, was 44°, i.e., a high value. It is considered that the heat of the heated insulator 2 was transmitted from the first insulator stepped portion 27 to the copper packing having a high thermal conductivity and then to the first metallic shell stepped portion 55 of the metallic shell 1 with efficiency. Accordingly, it was determined that by using a material having a high thermal conductivity such as copper (or aluminum) for the plate packing 8, the heat resistance could be improved sufficiently.

EXAMPLE 10

Figure 13:
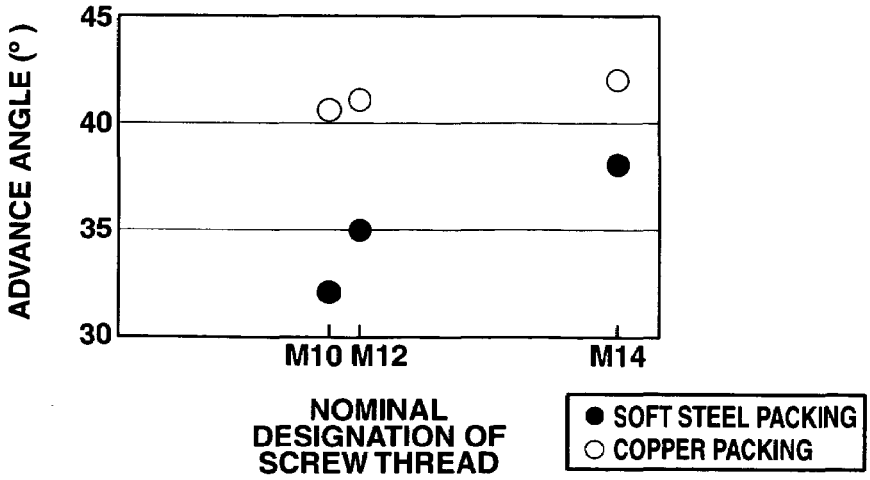
FIG. 13 is a graph showing the result of a heat resistance test of the spark plug 100 which is varied in the nominal designation of screw thread in the respective cases where the copper packing and the soft steel packing are used.

Then, the result of the heat resistance test of the spark plug, depending upon a variation of the thread diameter and a difference between the copper packing and the conventional soft steel packing will be described with reference to FIG. 13. FIG. 13 is a graph showing the result of the heat resistance test of the spark plug 100, depending upon a variation of the designation of screw thread (thread diameter) and a difference between the copper packing and the conventional soft steel packing. Test examples of the spark plugs 100, in which the designation of screw thread of the thread portion 7 was M14, M12 and M10, were prepared. The result of the heat resistance test is shown in FIG. 13. In the meantime, the length of the metallic shell intermediate diameter portion 56 was 1.5 mm, the length from the J portion to the front end of the metallic shell 1 was 12.9 mm, and the minimum clearance β' was 0.4 mm. In the meantime, in FIG. 13, the abscissa indicates the designation of screw thread and the ordinate indicates the pre-ignition occurrence advance angle. In FIG. 13, ● indicates the spark plug 100 in which the soft steel packing was used, and ○ indicates the spark plug 100 in which the copper packing was used. In the meantime, the test condition of the heat resistance test was the same as described above.

As shown in FIG. 13, in case of the spark plug 100 in which the conventional soft steel packing was used, the pre-ignition occurrence advance angle was 32° with M10, the pre-ignition occurrence advance angle was 35° with M12, and the pre-ignition occurrence advance angle was 38° with M14. On the other hand, in case of the spark plug 100 in which the copper packing was used, the pre-ignition occurrence advance angle was 40.5° with M10, the pre-ignition occurrence advance angle was 41° with M12, and the pre-ignition occurrence advance angle was 42° with M14, such that with any designation of screw thread, a higher pre-ignition occurrence advance angle than that in case of the spark plug 100 in which the conventional soft steel packing was used, was obtained. Further, regarding the rate of increase of the pre-ignition occurrence advance angle at each designation of screw thread in case the copper packing was used in place of the conventional soft steel packing, the rate of increase was 21.0% with M10, the rate of increase was 14.6% with M12, and the rate of increase was 9.5% with M14. Accordingly, it was found that a higher rate of increase of the pre-ignition occurrence advance angle was obtained when the copper packing was used with a smaller designation of screw thread such as M10 and M12. It is considered that this is because the spark plug 100 of a smaller designation of screw thread allows the temperature of the spark plug front end portion to rise more rapidly than the spark plug 100 of a larger designation of screw thread and therefore the effect of the copper packing having a higher thermal conductivity can be obtained more readily. Accordingly, it was determined that the heat resistance can be improved largely when the copper plate packing 8 was used for the spark plug 100 of the designation of screw thread of the thread portion 7 being M12 or less.

As having been describe as above, with the spark plug 100 according to the first embodiment of the present invention, the clearance β is regulated so as to be 0.45 mm or less, whereby even when the spark plug is put in a condition where it is liable to be fouled, intrusion of unburnt gas into the space Q can be prevented assuredly, thus making it possible to improve the fouling resistance. Further, since the metallic shell smaller diameter portion 56 and the insulator intermediate diameter portion 28 are positioned adjacent to each other, the thermal value becomes higher and the heat resistance is improved. Further, the length A of the clearance β, which is extended from the J portion of the plate packing 8 in the direction of the axis O is regulated so as to be in the range from 1.2 to 5 mm (preferably, in the range from 1.5 to 3 mm), the amount of heat transmitted from the insulator 2 to the metallic shell 1 can be regulated suitably. Further, by regulating removal of heat (thermal value) of the spark plug 100, not only the heat resistance but the fouling resistance can be improved.

Further, since the included angle θ between the second insulator stepped portion 29 and the insulator intermediate portion 28 is regulated so as to be 10° or more, the space between the outer circumferential surface of the insulator smaller diameter portion 30 and the inner circumferential surface of the metallic shell larger diameter portion 58 can be larger. Accordingly, internal firing is hard to be caused, thus making it possible to improve the fouling resistance.

Since the length Z of the insulator intermediate diameter portion 28 in the direction of the axis O is regulated so as to be in the range from 1.0 to 6.0 mm, the length L of the spark plug 100 becomes adjustable. Accordingly, by suitably adjusting the thermal value of the spark plug, the heat resistance and the fouling resistance can be improved.

Further, by regulating the relative position between the metallic shell smaller diameter portion 56 and the insulator intermediate diameter portion 28, the amount of heat radiated from the insulator intermediate diameter portion 28 to the metallic shell smaller diameter portion 56 can be adjusted. Accordingly, the heat resistance and the fouling resistance of the spark plug 100 can be improved.

Further, since the packing 8 is made of a material having a thermal conductivity of 200 W/m·k or more (e.g., copper, aluminum, etc.), the heat of the heated insulator 2 is transmitted from the first insulator stepped portion 27 through the plate packing 8 to the first metallic shell stepped portion 55 efficiently. Accordingly, the removal of heat (amount of radiated heat) of the spark plug 100 is improved, thus making it possible to regulate the thermal value of the spark plug 100 and improve the heat resistance.

Further, the plate packing 8 made of a material having a high thermal conductivity such as copper, when used in the spark plug 100 of M12 or less (e.g., M10 and M12) the temperature of the front end portion of which rises rapidly, makes it possible to obtain an effect of improving the heat resistance of the spark plug 100 more assuredly.

In the meantime, the present invention is not limited to the above-described spark plug 100 according to the first embodiment but various modifications may be made thereto. Hereinafter, the spark plugs 200 and 300 according to the second and third embodiments will be described with reference to FIGS. 14 to 16.

Figure 14:
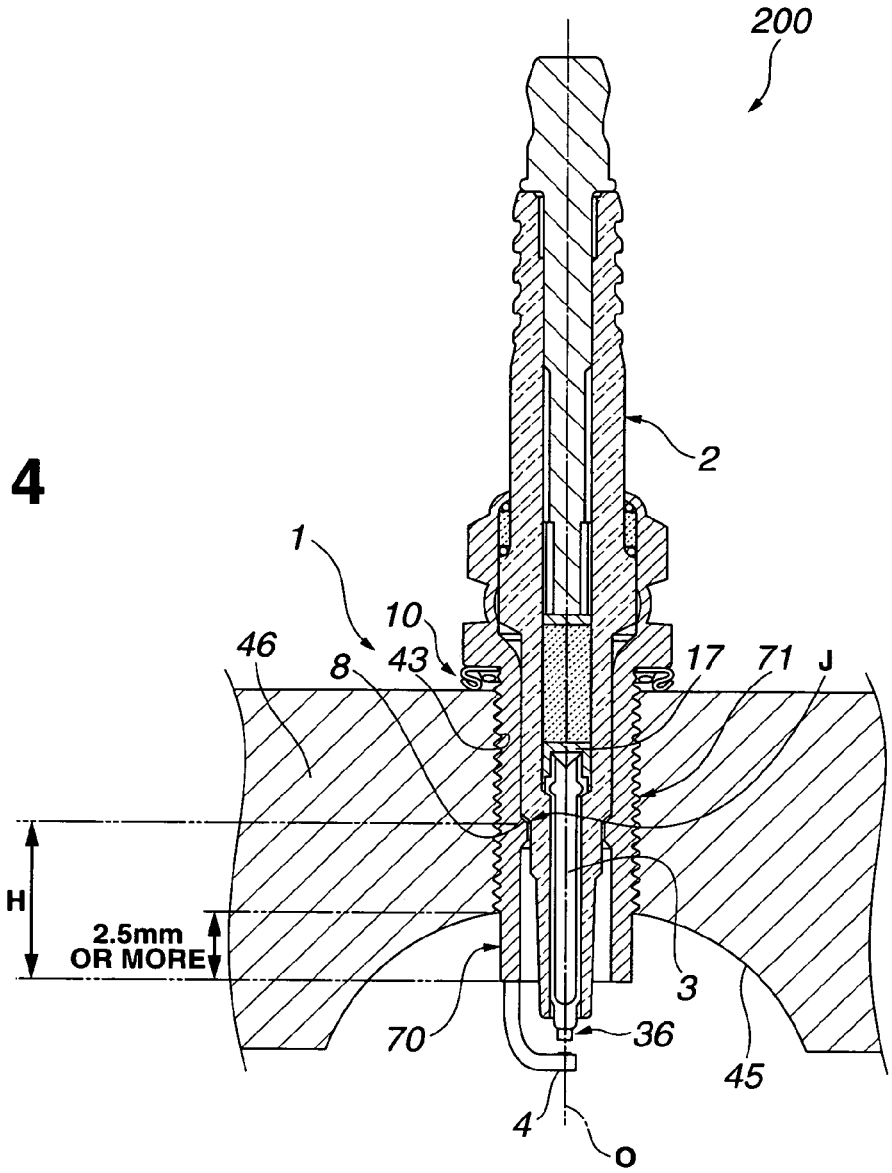
FIG. 14 is a longitudinal sectional view of a spark plug 200 according to a second embodiment of the present invention, in a state of being installed on an engine head 46.
Figure 15:
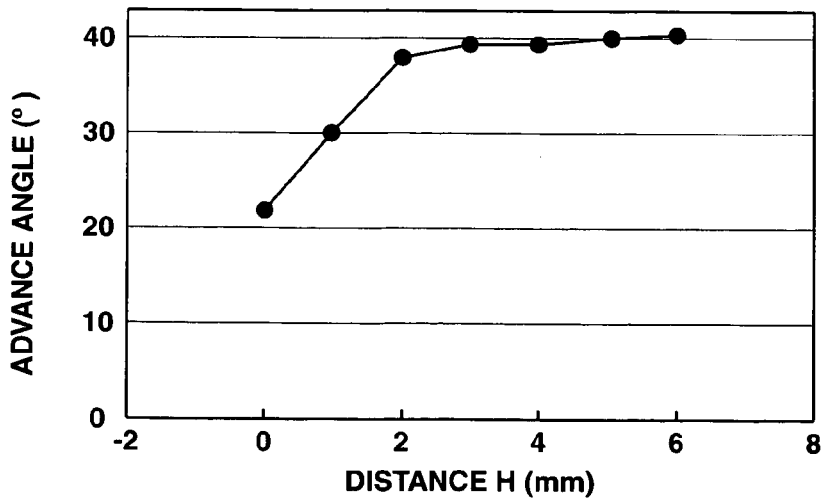
FIG. 15 is a graph showing the result of a heat resistance test of the spark plug 200, depending upon a variation of the distance H.

First, the spark plug 200 according to the second embodiment of the present invention will be described with reference to FIGS. 14 and 15. In the meantime, FIG. 14 is a longitudinal sectional view of the spark plug 200 in a state of being mounted on the engine head 46, and FIG. 15 is a graph showing the result of the heat resistance test of the spark plug 200, depending upon a variation of the distance H. In the meantime, the spark plug 200 is used for ignition in an internal combustion engine such as an automotive gasoline engine similarly to the spark plug 100 of the first embodiment. In the spark plug 200, the length from the front end portion of the thread portion 71 formed on the outer peripheral surface of the metallic shell 1 to the front end portion of the metallic shell 1 is 2.5 mm or more, and the distance from the front end of the metallic shell 1 in the direction of the axis O to the J portion of the plate packing 8 is regulated so as to allow the front end portion of the spark plug 100 to protrude into the combustion chamber 45 of the engine head 46 with a view to improving the fouling resistance of the spark plug 100.

The spark plug 200 has almost the same structure as the spark plug 100 of the first embodiment 100 and differs only in that the distance H from the front end of the metallic shell 1 in the direction of the axis O to the J portion of the plate packing 8 is regulated. Accordingly, description will herein be made as to only the distance from the front end of the metallic shell 1 to the J portion of the plate packing 8 in the spark plug 200 of the second embodiment, and description as to the structure of the other portion is omitted by using the description of the first embodiment in place thereof.

As shown in FIG. 14, the thread portion 71 of the spark plug 200 of the second embodiment 200 is formed at the rear end side of the straight portion 70 of the metallic shell 1. The length of the straight portion 70 in the direction of the axis O is regulated so as to be 2.5 mm or more. Herein, the distance from the front end of the metallic shell 1 in the direction of the axis O to the J portion of the plate packing 8, which is parallel with the direction of the axis O is defined as a distance H. In this instance, the distance H (mm) is regulated so as to be 2 mm or more. Then, as shown in FIG. 14, the spark plug 200 is screwed into a plug hole 43 provided to the engine head 46 and formed with a female thread till the gasket 10 is abuttingly engaged with the engine head 46 thereby causing the ground electrode 4, the electrode front end portion 36 of the center electrode 3 and the front end portion of the metallic shell 1 to be exposed to the inside of the combustion chamber 45.

With the conventional wide range type spark plug, if the J portion of the plate packing 8 lies over a place that is spaced, toward the rear end side in the direction of the axis O, by 2 mm from the front end of the metallic shell 1 in the direction of the axis O (distance H=2 mm), the thermal value of the spark plug is deteriorated considerably such that the spark plug can not fulfill its function due to melting of the insulator 2 or the like. However, with the spark plug 200 according to the second embodiment of the present invention, decrease in the thermal value (removal of heat) is not caused even when the distance H shown in FIG. 14 is 2 mm.

EXAMPLE 11

Then, the result of the heat resistance test of the spark plug 200, depending upon a variation of the distance H will be described with reference to FIGS. 14 and 15. In the test, test examples of the spark plug 200, in which the distance H was varied in the range from 0 to 6 mm were prepared. The result is shown in the graph of FIG. 15. In the meantime, the prepared test examples of the spark plug 200 were configured such that the length of the metallic shell smaller diameter portion 56 (refer to the spark plug 100 shown in FIG. 2) was 1.5 mm and the minimum clearance β' was 0.4 mm. The length of β in parallel with the direction of the axis O (refer to the metallic shell smaller diameter portion 56 of the spark plug 100 shown in FIG. 2) was fixed at 3 mm. Further, in FIG. 15, the ordinate indicates the pre-ignition occurrence advance angle and the abscissa indicates the distance H (mm). In the meantime, the test condition of the heat resistance test was the same as described above.

As shown in FIG. 15, the pre-ignition occurrence advance angle was 22° when the distance H from the front end of the metallic shell 1 to the J portion of the packing 8 was zero, the pre-ignition occurrence advance angle was 30° when H=1 mm, the pre-ignition occurrence advance angle was 38.0° when H=2 mm, the pre-ignition occurrence advance angle was 39.5° when H=3 mm, the pre-ignition occurrence advance angle was 39.5° when H=4 mm, the pre-ignition occurrence advance angle was 40° when H=5 mm, and the pre-ignition occurrence advance angle was 40.5° when H=6 mm.

As shown in FIG. 15, the solid line in FIG. 15 was in the form of a straight line ascending rightward till the distance H=2 mm and nearly equally values were obtained when H=2 mm or more. While the conventional spark plug caused a rapid decrease in the thermal value (advance angle) when H=2 mm or less, the spark plug 200 scarcely caused decrease in the thermal value even when the distance H=2 mm since it has an excellent heat resistance. Accordingly, as shown in FIG. 15, it was determined that when the distance H=2 mm or more, in which the pre-ignition occurrence advance angle was held at or around 40°, the heat resistance of the spark plug 200 was improved and also the fouling resistance was improved.

As having been described, by the spark plug 200 according to the second embodiment of the present invention, the length of the straight portion 70 of the metallic shell 1 is regulated so as to be 2.5 mm or more and the distance H (the distance from the front end portion of the metallic shell 1 in the direction of the axis O to the J portion of the plate packing 8) was regulated so as to be 2 mm or more, whereby not only the ground electrode 4 and the center electrode 3 of the spark plug but the front end side of the metallic shell 1 is assuredly exposed to the inside of the combustion chamber 45 of the engine. Further, since the spark plug 200 has the effect of the first embodiment, the thermal value is not decreased even when the front end side of the metallic shell 1 in the direction of the axis O was overheated.

Figure 16:
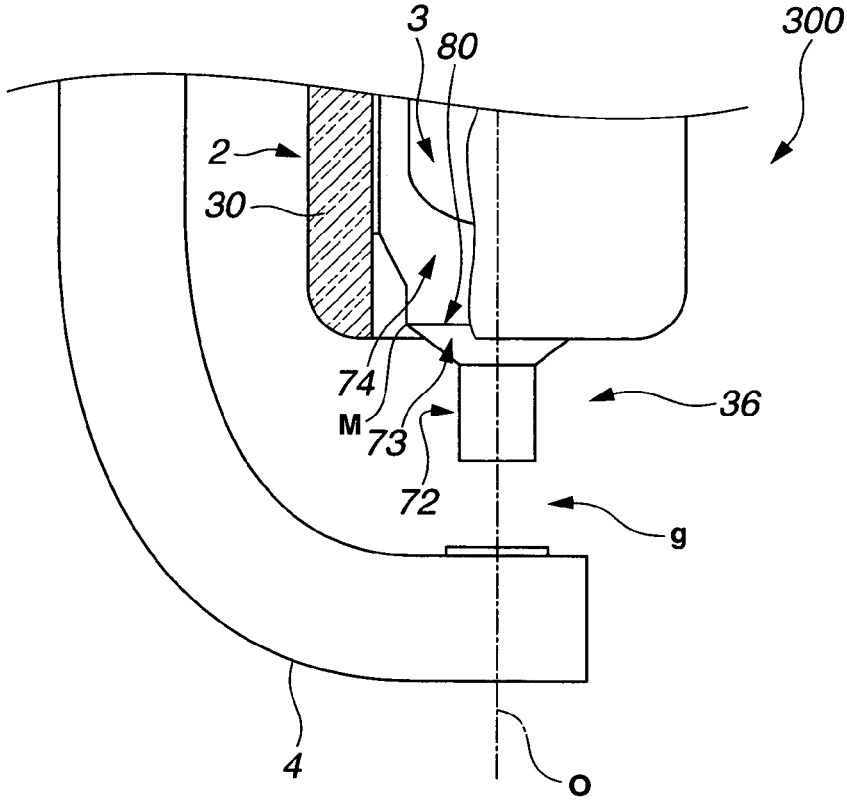
FIG. 16 is an enlarged, fragmentary, longitudinal sectional view of a front end side principal portion of a spark plug 300 according to a third embodiment of the present invention.

Then, a spark plug 300 according to the third embodiment of the present invention will be described with reference to FIG. 16. FIG. 16 is a fragmentary longitudinal sectional view showing a front end side principal potion of the spark plug according to the third embodiment of the present invention in an enlarged scale. In the meantime, the spark plug 300 used for ignition in an internal combustion engine such as an automotive gasoline engine, similarly to the first and second embodiments. The spark plug 300 is configured so that with respect to the electrode front end portion 36 of the center electrode 3, which protrudes from the front end portion of the insulator 2 in the direction of the axis O, a reduced diameter front end part of the electrode front end portion 36 is disposed inside the through hole 6. In the meantime, the spark plug 300 of the third embodiment has almost the same structure as the first embodiment and differs only in that a part of the electrode front end portion 36 of the center electrode 3, which protrudes from a front end side opening portion of the insulator 2 in the direction of the axis O, is regulated. Accordingly, description is made as to only the electrode front end portion 36 of the center electrode 3 in the spark plug 300 of the third embodiment, which protrudes from the front end portion of the insulator 2 in the direction of the axis O and description as to the structure of the other portion is omitted by using description of the first embodiment in place thereof.

As shown in FIG. 16, the electrode front end portion 36 of the center electrode 3 in the spark plug 300 of the third embodiment includes a center electrode larger diameter portion 74 provided at the rear end side in the direction of the axis O, a center electrode smaller diameter portion 72 disposed at the front end side of the center electrode larger diameter portion 74 and having a smaller outer diameter than the center electrode larger diameter portion 74 and a center electrode stepped portion 73 connecting between the center electrode smaller diameter portion 72 and the center electrode larger diameter portion 74. In the meantime, it is assumed that M denotes an intersecting point between the center electrode stepped portion 73 and the center electrode larger diameter portion 74. Further, in the spark plug 300 of the third embodiment, the center electrode smaller diameter portion 72 nearly bar-shaped is smaller in diameter than the center electrode smaller diameter portion of the conventional spark lug, with a view to improving the spark condition (firing condition) at the spark discharge gap g. By this, the area which is to be processed by a self-cleaning action is made relatively smaller for thereby improving the self-cleaning ability.

Further, as shown in FIG. 16, the electrode front end portion 36 of the center electrode 3 protrudes from the front end side opening portion of the insulator smaller diameter portion 30 of the insulator 2. The intersecting point M is positioned at a side closer to the rear end than the front end part of the insulator smaller diameter potion 30 of the insulator 2. Accordingly, the electrode front end portion 36 protruding from the open end portion of the insulator smaller diameter portion 30 of the insulator 2 includes the center electrode smaller diameter portion 72 and part of the center electrode stepped portion 73.

As shown in FIG. 16, since the intersecting point M is positioned inside the insulator smaller diameter portion 30 of the insulator 2, the edge portion 80 formed at the joint between the center electrode diameter portion 74 and the center electrode stepped portion 73 is positioned inside the insulator smaller diameter portion 30. Since the edge portion 80 of the center electrode of the conventional spark plug is positioned outside the insulator smaller diameter portion 30, carbon or the like is adhered to the edge portion. When carbon is adhered to the edge portion 80, there may occur a case in which the edge serves as a base point and cooperates with the ground electrode to cause there across spark jumping. However, with the spark plug of the third embodiment 300, even if, for example, carbon is adhered to the center electrode smaller diameter portion 72 and the center electrode stepped portion 73 due to the progress of fouling of the electrode front end portion 36, carbon is not adhered to the edge portion 80 since the edge portion 80 is not positioned on the front end side of the insulator smaller diameter portion 30. Accordingly, spark jumping caused across the edge portion 80 serving as the base point and the ground electrode 4 can be prevented and an effective counter measure for preventing carbon fouling can be obtained. Further, while the center electrode smaller diameter portion 72 of the spark plug 300 of the third embodiment is reduced in diameter and the electric field strength with the spark discharge gap g is intensified, spark jumping to the edge portion 80 is not caused and leakage (leakage of electricity) to the outer peripheral surface of the insulator 2 does not occur since the edge portion 80 is not positioned at the front end side of the insulator smaller diameter portion 30.

As having been described above, with the spark plug 300 according to the third embodiment of the present invention, the intersecting point M, when observed in a section made by a plane including the axis, is positioned inside the insulator smaller diameter portion 30 of the insulator 2. Accordingly, the edge portion 80 formed at the joint between the center electrode larger diameter portion 74 and the center electrode stepped portion 73 is positioned inside the insulator smaller diameter portion 30. Since the edge portion 80 is not positioned at the front end side of the insulator smaller diameter portion 30, spark jumping across the edge portion 80 serving as a base point and the ground electrode 4 can be prevented and there does not occur leakage (leakage of electricity) to the outer peripheral surface of the insulator 2.

In the meantime, the present invention is not limited to the above-described specific embodiments but various modifications thereof may be made according to the purpose and usage within the scope of the present invention.

Figure 17:
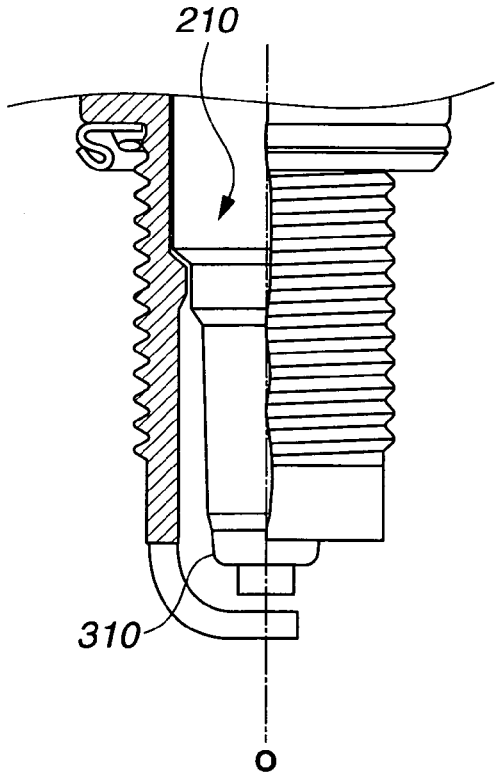
FIG. 17 is an enlarged, fragmentary, longitudinal sectional view of a front end portion of a spark plug according to a first variation.
Figure 18:
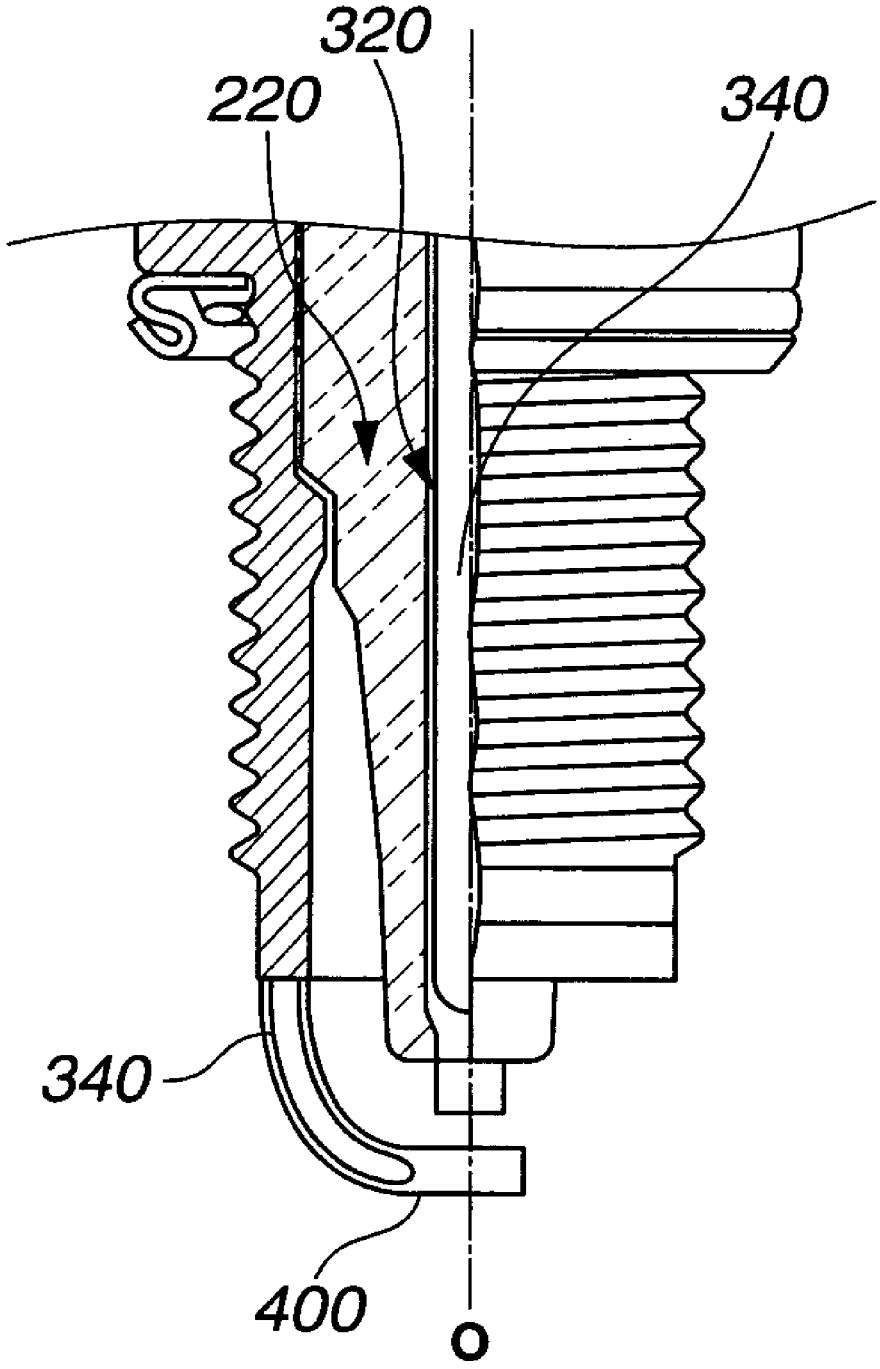
FIG. 18 is an enlarged, fragmentary, longitudinal sectional view of a front end portion of a spark plug according to a second variation.

For example, while in the spark plug 100 of this invention the insulator smaller diameter portion 30 of the insulator 2 reduces in diameter toward the front end side in the direction of the axis O, this is not for the purpose of limitation but, as shown in FIG. 17, a reduced diameter portion 310 may be formed at the front end side of an insulator 210 in the direction of the axis O. Further, as in a spark plug according to a second modification shown in FIG. 18, the front end side of an insulator 220 in the direction of the axis O may be formed parallel with the direction of the axis O. Further, while in the spark plug 100 the center electrode 3 is formed with the core member 33, this is not for the purpose of limitation but a center electrode 320 embedded in an insulator 220 and a ground electrode 400 maybe formed with insulator members 340, respectively.

INDUSTRIAL APPLICABILITY

The spark plug 100 of the present invention can be applied to a spark plug used for ignition for an internal combustion engine such as an automotive gasoline engine and is useful for various spark plugs such as a traditional ground type spark plug, a semi-surface discharge type spark plug, an intermittent discharge type spark plug and a multi ground type spark plug.

The invention claimed is:

1. A spark plug comprising a tubular insulator having an axial through hole and a first insulator stepped portion that reduces an outer diameter of the tubular insulator toward a front end side of the tubular insulator, a rod-shaped center electrode disposed in the through hole of the insulator, a metallic shell having a first metallic shell stepped portion that reduces an inner diameter of the metallic shell toward a front end side of the metallic shell and supporting the insulator through engagement of the first metallic shell stepped portion and the first insulator stepped portion by interposing therebetween a packing, and a ground electrode connected at one end to a front end surface of the metallic shell and facing the other end portion of the ground electrode toward the center electrode for thereby forming a spark discharge gap between said other end portion and the rod-shaped center electrode, characterized in that:

the tubular insulator and the metallic shell, when observed in a section made by a plane including the axis of the spark plug, have therebetween a gap of less than 0.45 mm at a more front end side of the tubular insulator than an engagement position of the packing and the first insulator stepped portion; and the gap between the tubular insulator and the metallic shell is provided axially from a most front end side engagement position of the packing and the first insulator stepped portion as a starting point to a finishing point that is apart from the starting point by 1.2 mm or more toward the front end side of the metallic shell while being apart from the front end surface of the metallic shell by 7.9 mm or more toward a rear end side of the tubular insulator.

2. A spark plug according to claim 1, characterized in that the gap between the insulator and the metallic shell is provided axially from the starting point to a finishing point that is apart from the starting point by 1.5 mm or more toward the front end side of the metallic shell while being apart from the front end surface of the metallic shell by 9.9 mm or more toward the rear end side of the tubular insulator.

3. A spark plug according to claim 1, characterized in that the tubular insulator includes, at a more front end portion than the first insulator stepped portion, a second insulator stepped portion that reduces in diameter toward the front end side of the metallic shell, the metallic shell includes, at a more front end side than the first metallic shell stepped portion, a second metallic shell stepped portion that increases in diameter toward the front end side of the metallic shell, and the difference in outer diameter of the tubular insulator between a front end and a rear end of the second insulator stepped portion is larger than the difference in inner diameter of the metallic shell between a front end and a rear end of the second metallic shell stepped portion.

4. A spark plug according to claim 3, characterized in that the second insulator stepped portion, when observed in a section made by a plane including the axis of the spark plug, forms an included angle of 10° or more with a line parallel with the axis.

5. A spark plug according to claim 3, characterized in that the rear end of the second insulator stepped portion is axially disposed at a more front end side than the front end of the first insulator stepped portion by an amount ranging from 1 to 6 mm.

6. A spark plug according to claim 3, characterized in that the rear end of the second insulator stepped portion is axially apart from the front end surface of the metallic shell by 7 mm or more.

7. A spark plug according to claim 3, characterized in that the rear end of the second insulator stepped portion, when observed in a section made by a plane including the axis of the spark plug, is axially apart from the rear end of the second metallic shell stepped portion as a starting point by an amount ranging from −0.5 to 3 mm wherein the amount apart from the starting point toward the front end side of the metallic shell is designated by a positive value.

8. A spark plug according to claim 1, characterized in that the packing is made of a material having a thermal conductivity of 200 W/m·k or more.

9. A spark plug according to claim 1, characterized in that a thread portion is formed on an outer circumferential surface of the metallic shell and the nominal designation of the thread portion is M12 or less.

10. A spark plug according to claim 9, characterized in that the axial length from a front end of the thread portion to the front end of the metallic shell is 2.5 mm or more.

11. A spark plug according to claim 10, characterized in that the distance from the front end of the metallic shell to the most front end side engagement position of the packing and the first insulator stepped portion is 2 mm or more.

12. A spark plug according to claim 1, characterized in that the rod-shaped center electrode includes a first center electrode stepped portion increasing in outer diameter toward a rear end side of a center electrode, a center electrode minimum diameter portion connected to a rear end side of the first center electrode stepped portion, a second center electrode stepped portion connected to a rear end side of the center electrode minimum diameter portion and increasing in outer diameter toward a rear end side of the center electrode, and a center electrode maximum diameter connected to a rear end side of the second center electrode stepped portion, and the front end of the insulator is located between the first insulator stepped portion and the second insulator stepped portion when observed in a section made by a plane including the axis of the spark plug.

* * * * *